US011313084B2

(12) United States Patent
Frottier

(10) Patent No.: US 11,313,084 B2
(45) Date of Patent: Apr. 26, 2022

(54) DEVICE FOR FORMING A LEVEL CROSSING

(71) Applicant: Het Elastomertechnik GmbH, Wiesbaden (DE)

(72) Inventor: Jean-Pierre Frottier, Siebnen (CH)

(73) Assignee: Het Elastomertechnik GmbH

( * ) Notice: Subject to any disclaimer, the term of this patent is extended or adjusted under 35 U.S.C. 154(b) by 755 days.

(21) Appl. No.: 16/300,686

(22) PCT Filed: Jul. 15, 2016

(86) PCT No.: PCT/EP2016/066892
§ 371 (c)(1),
(2) Date: Nov. 12, 2018

(87) PCT Pub. No.: WO2017/029038
PCT Pub. Date: Feb. 23, 2017

(65) Prior Publication Data

US 2019/0161920 A1 May 30, 2019

(30) Foreign Application Priority Data

Aug. 19, 2015 (DE) ..... 102015113728.3

(51) Int. Cl.
*E01B 7/28* (2006.01)
*E01C 9/04* (2006.01)
(Continued)

(52) U.S. Cl.
CPC ..... *E01C 9/04* (2013.01); *E01B 7/22* (2013.01); *E01B 7/28* (2013.01); *E01C 9/083* (2013.01)

(58) Field of Classification Search
CPC ... E01B 7/22; E01B 7/28; E01B 21/00; E01B 15/00; E01B 3/40; E01C 9/04; E01C 9/083
(Continued)

(56) References Cited

U.S. PATENT DOCUMENTS 1,613,850 A * 1/1927 Scherm ..... E01C 9/04 238/8
1,627,800 A * 5/1927 Mills ..... E01C 9/04 238/8
(Continued)

FOREIGN PATENT DOCUMENTS

DE 3027090 A1 2/1982
EP 0281013 A2 9/1988
(Continued)

OTHER PUBLICATIONS

European Office Action, Serial No. 16738818.0-1002, Applicant: HET Elastomertechnik GmbH, dated Apr. 4, 2019.
(Continued)

*Primary Examiner* — Mark T Le
(74) *Attorney, Agent, or Firm* — Reising Ethington P.C.

(57) ABSTRACT

A device for setting up a level crossing for crossing a track section having two rails, comprising one or more mouldings forming at least one part of a traffic surface of the railway crossing across the rails, and at least one moulding holder fixable to one of the two rails, wherein the moulding(s) is/(are) detachably attachable to at least one of the two rails by means of the moulding holder, wherein the moulding holder comprises two holding clamps fixable to the rail in juxtaposition to each other on both sides of the rail, and wherein the two holding clamps can be braced to each other such as to clamp the rail foot between the two holding clamps.

19 Claims, 25 Drawing Sheets

(51) Int. Cl.
*E01B 7/22* (2006.01)
*E01C 9/08* (2006.01)

(58) Field of Classification Search
USPC ..... 238/3, 8
See application file for complete search history.

(56) References Cited

U.S. PATENT DOCUMENTS

| | | | | |
|---|---|---|---|---|
| 1,729,360 | A * | 9/1929 | Price | E01C 9/04 238/8 |
| 2,067,037 | A | 1/1937 | Alexander | |
| 3,056,555 | A | 10/1962 | Eisses | |
| 3,557,670 | A | 1/1971 | Sutton | |
| 4,009,827 | A * | 3/1977 | Tafel | B29B 17/0412 238/8 |
| 4,365,743 | A * | 12/1982 | Trickel | B29B 17/0042 238/382 |
| 5,201,467 | A * | 4/1993 | Kennel | E01B 21/00 238/8 |
| 7,988,066 | B2 * | 8/2011 | Hughes | E01C 9/04 238/8 |
| 8,864,084 | B2 * | 10/2014 | Honeck | F16M 13/022 246/415 R |

FOREIGN PATENT DOCUMENTS

| | | | |
|---|---|---|---|
| EP | 0639670 | A2 | 2/1995 |
| EP | 0904463 | A1 | 3/1999 |
| EP | 1225279 | A2 | 7/2002 |
| JP | 2004339787 | A | 12/2004 |
| JP | 3125803 | U | 10/2006 |
| JP | 2008175048 | A | 7/2008 |
| JP | 2015190638 | A | 11/2015 |

OTHER PUBLICATIONS

Japanese Office Action, JP Application No. 2018-528381, Applicant: Yuzuru Okabe, dated Sep. 12, 2019.

German Office Action, Serial No. 102015113728.3, Applicant: Het Elastomertechnik GmbH, dated Jun. 29, 2016.

International Search Report and Written Opinion, Int. Serial No. PCT/EP2016/066892, Int. Filing Date: Jul. 15, 2016, Applicant: Het Elastomertechnik GmbH, dated Dec. 6, 2016.

International Search Report, Int. Serial No. PCT/EP2016/066892, Int. Filing Date: Jul. 15, 2016, Applicant: Het Elastomertechnik GmbH, dated Jul. 15, 2016.

* cited by examiner (a) (b)

DEVICE FOR FORMING A LEVEL CROSSING

TECHNICAL FIELD

The present disclosure relates to a device for setting up a railway crossing for to crossing a railway track.

BACKGROUND AND SUMMARY

Crossings of a railway track with roads, lanes or places can be realized by dispensing with the construction of flyovers or underpasses with level crossings. In order that a railway crossing for road-bound traffic is passable, but a levelling of height differences in the track plate, for example a balancing of the difference in height is required between the surface of the track bed and the running surfaces of the rails. For this purpose, areas are typically filled in the space between the rails, and at their outer sides in the approximate level up to the rail height, whereby in the rail region lateral to the railheads wheel ruts wheel flanges of the train wheels remain. A known approach is to attach mouldings specially manufactured in the intermediate space of the rails and on their outer sides.

EP 0639670 B1 describes mouldings units, made of rubber material, and formed for railroad crossing facilities. In this case, outer plates have projections for gripping under the rail heads, while middle plates are held in position by its own weight, complementarily formed are tongue and groove joints and centring elements. Special measures for securing to the roadbed or track grid are not provided. Said device is particularly designed for bicycle friendliness. For larger stresses, for example, due to persons or trucks, however, there is a risk that plates slip as a result of forces during braking or acceleration of the vehicles or by deformation of the plates, for example, due to load, aging or temperature fluctuations. Even plates can be lifted up by unauthorized persons or jump upwards in case of unilateral extreme loads.

EP 0,281,013 B1 discloses plates for railway crossings, which may consist of a relatively rigid and hard elastic material and which are equipped with expansion folds. The expansion folds are realized by grooves, in particular in the top plate surface. However, these grooves may represent undesired indentations in the road, which in turn can be dangerous particularly for cyclists and pedestrians with high heels shoes and can also act as collection points for dirt. For large forces during braking and acceleration of vehicles in turn, there is a risk of slippage of plates. There is also the possibility that plates are lifted upwards by unauthorized personnel. Underneath the plates, there is a base made of wood blocks, and that is, filler blocks, which cover the sleeper attachment units, and as a result, the construction of a railway crossing as a whole becomes relatively expensive.

EP 1 225 279 A2 a track transition construction is shown with which a Track junction is formed by a plurality of discrete closely spaced mouldings, which in the longitudinal direction of the track one another with mechanical connection means are connected. The mechanical connecting means are in the form of braces and adjustable to each other and in the longitudinal direction of the track at a location with a sleeper. Conveniently, only a single retaining clip is to be fixed in a moulding series on a sleeper. The stability thus achieved may not be enough for heavily used crossings sometimes. Another disadvantage is that the mouldings are not effectively secured against being lifted upward so that they could be removed by unauthorized persons.

EP 0904463 B1 describes a device for fixing the position of mouldings, following successively in a longitudinal direction of the track system, of a railroad crossing means. The mouldings are coupled together by means of fixing rods, which extend in the longitudinal direction along the track system, to form a unit. At or in the vicinity of the end regions of the fixing rods, the end regions are tightly coupled or can be tightly coupled and brought to the system at a respective end face of the moulding in longitudinal direction. Further, at least one intermediate abutment means is provided which is tightly coupled, or can be tightly coupled between the end regions of fixing rods and can be brought to the system at a designated contact surface on one of the mouldings. Overall, a variety of specific components are foreseen for positional fixing of mouldings. Thus, the system is relatively complex, whereby the construction of track transition devices relatively expensive and the corresponding training of personnel can be costly. Also, different variants of fixing-rod fasteners are described, which are intended for different types of sleepers. Fixing rod fasteners for concrete or metal thresholds are only placed on such thresholds; associated mouldings can thus be together with the fixing rod being lifted upward. The positional fixing of the moulding may also be in need of improvement for heavily used railway crossings. It is, therefore, an object of the invention to provide a device to set up a railroad crossing, in which the disadvantages described are avoided, which is particularly especially tightly fixed in the installed state, which precludes a shifting of mouldings along and transverse to the railway track and an upward lifting, which prevents the development of gaps between the mouldings, which includes as few components and/or which can be easily assembled and dismantled.

This object is solved by the subject matters of the independent claims. Preferred embodiments of the present disclosure are subject of the dependent claims. It envisages a device for setting up a railway crossing for crossing a track section. The crossing of the track section takes place at the level of railway track itself, so it relates to a level crossing of the railway track, as opposed to an underpass or a flyover.

An intersecting track section presents a particular carriageway for rail vehicles, extending along a track bed, especially for vehicles that are mechanically guided with wheels on the rails, such as trains or rail-bound passenger transport means, such as trams or underground railways. In a track section, over which a railroad crossing can be set up by means of the device, it relates, in particular, to a railway, tramway or subway route. A railway track may in this case have one or more, in particular parallel, tracks. A track in turn typically comprises two parallel rails on sleepers. A track may comprise more than two rails sometimes, such as in the case of three- or multi-rail tracks, which are driven with railway vehicles of different track width, or in the case of a traction power supply to railcars by means of additional busbars. Usually, the rails are mounted on sleepers made of wood, concrete, steel or plastic lying at the regular interval in the track bed. The track plate formed by rails and sleepers is typically stored in a track bed of gravel.

The device is particularly prepared for crossing a track section with a traffic area for motorized and/or non-motorized road users, so that the road users can cross the track section over the level crossing. In the case of railway track crossing the traffic area, it relates to a road, a path or a place or a portion thereof which is provided for specific road users, for example, the roadway, the bicycle path or the pedestrian path of a street. The level crossing is envisaged for motorized traffic goers (such as passenger vehicles and trucks, motorcycles, mopeds, etc.) and/or non-motorized road users (cyclists, pedestrians, riders, etc.). The device is designed such that a level crossing can be set up across tracks which are driveable and/or accessible, the crossing is easy passable for different road users.

The device is adapted for crossing a track section, which comprises at least two rails. This is typically a pair of rails of a track. However, it can also relate to two tracks of different, in particular adjacent running tracks. The rails each comprise a rail base, a rail head and a rail web interconnecting the rail head and the rail base.

Preferably, it is used as a railway track, tramways or Vignol rails used for underground rails (flat bottom rails). However, other types of rails are also considered, such as grooved rails, thick web rails, crane rails, switch rails, full tracks, block rails, square rails.

The device comprises at least one repeatedly usable and retrievable intermediate-rails moulding, which is arranged between two rails when the device is installed. Further, the device comprises at least in each case multi-deployable and retrievable first and second track outer-side mouldings, which are adjacent to the outer side of the first and second rail when the device is installed. The mouldings are arranged in the installed state so that the first rail outer side moulding, intermediate-rail moulding and the second track outer-side mouldings together form a part of the traffic area of the level crossing, for example, in horizontal continuation of the traffic area, transverse to the rails.

To the person skilled in the art it is obvious that intersecting track section may comprise more than two rails, in particular several parallel tracks. In the case of two rails, which are each set up as a pair of rails, the traffic area of the railway crossing can be so set up that an intermediate-rail moulding each is arranged between the two rails of each track, further a first rail outer moulding is arranged between the rails, that is, adjoining both at the outside of the second track of the first rail and also at the outside of the first track of the second rail, further a second track outer-side mouldings adjoins the outer side of the first track of the first rail, and finally bordering a third track outer-side moulding at the outside of the second track of the second rail.

A traffic area of the level crossing set up by the driveable and/or accessible plate-shaped mouldings includes a gap caused by the railway track a gap in a traffic area, such as a street, intersecting the track section.

Accordingly, a traffic area set up with mouldings is prepared, in order to allow motorized and/or non-motorized road users to smoothly pass the crossing the traffic area transversely, in particular vertically above the rails of the railway track, but not to provide the non-rail-bound vehicles, a roadway to drive along the rails.

Further, the device comprises at least one cross bore through the rail web of at least one of the two rails in the region of one of the adjacent mouldings. The cross bore is a bore drilled in the rail web, which runs transverse, preferably perpendicular to the longitudinal direction of the rail through the rail web, such that the two rail chambers communicate with each other on both sides of the rail.

Finally, the device comprises at least one fastener which extends through the cross bore in the rail web of the rail, wherein one of the mouldings can be and/or is secured detachably by means of fastening means through the cross bore. The fastening elements thus extends transverse, preferably perpendicular to the longitudinal direction of the rails through the cross bore. The moulding that can be secured using fastening means has a receiving unit for the fastening means, in which the securing device engages. With the fastening means the said mouldings can be connected to the rail detachably but firmly, in particular without play. The moulding is therefore fixed by the fastener onto the rail with respect to all fixed directions, that is, in the direction along the rail, in the direction transverse to the horizontal rail and in vertically upward direction. In vertically upward direction, the moulding is secured preferably exclusively through at least one fastening means, for example according to an exemplary embodiment of the present disclosure, thereby not about the fact that the moulding engages in the rail chamber. The moulding is preferably secured also in the direction longitudinal to the rail exclusively by means of at least one fastening means, for example according to an exemplary embodiment of the present disclosure, thereby not about the fact that the moulding is coupled together with other, adjacent mouldings, extending along the rail. Finally, the moulding is secured in the direction transverse to the horizontal rail preferably exclusively by at least one fastening means.

The moulding fixed by the cross bore using fastener is thus directly secured to the rail and is therefore particularly stable against any longitudinal and transverse sliding to the rail.

For the construction of railway crossings, in particular with rubber-elastic mouldings, it is possible to fix at least one or some of the mouldings directly onto the rail, in order to ensure a high stability of the level crossing, in particular for crossing with heavy motor vehicles. While the fixed mouldings of all directions are secured to the securing means, the latter are steadily secured against lifting or jumping upward as a result of strongly one-sided loads.

The mounting as described is accompanied by a cross bore through a rail web. It has been found that such regular cross bores do not represent any unacceptable deterioration of stability of the rail even in Vignol rail.

The device for setting up the level crossing is so configured that the level crossing can be assembled and dismantled multiple times. Thus the fastening means can be released so as to loosen the detachable moulding from the rail. Moreover, all moulding can be removed from the associated rail.

The option of assembling and dismantling the level crossing several times in a simple manner assist able to execute maintenance or repair work on the railway track or on the track bed, in particular to ensure the re-lining of sleepers with gravel, for example to plug the track bed.

Further, the device also has a low number of different components. This allows cost-effective production and easy installation and dismantling of the level crossing.

In an embodiment of the present disclosure, the fastening means is configured as fastening bolt. The fastening bolt extends through the cross bore in the rail web and can be bolted onto the moulding body in order to tightly secure this moulding at the rail web.

A fixing bolt across the rail web is a particularly easy way to make a secure but detachable fastening of mouldings.

More preferably, the moulding secured by the fastener moulding can have a threaded insert on its narrow side facing the rail, so that the fastening bolt can be bolted in the threaded insert. A secure bolt joint, in particular in a moulding made of a rubber-elastic material, can be ensured in another way, such as by means of a cross-nut. Of course, the fastener designed at least as a fastening bolt, depending on the material of the moulding, in particular in a moulding made of wood, can be directly bolted together with or without a threaded insert.

In a further embodiment of the present disclosure, at least one of the mouldings facing the moulding that can be secured by the fastener on the other side of the same rail can be locked to the fastening elements in a longitudinal direction towards the perpendicular to secure this moulding against being lifted upward.

Said moulding is thus locked to the fastening elements so that it is secured against vertical movement upwards. However, the said mouldings remain movable particularly in longitudinal direction to the rail.

In a further embodiment of the present disclosure, at least one of the mouldings facing the moulding that can be secured by the fastener on the other side of the same rail, can be locked transverse to the fastening elements in a direction transverse to the perpendicular and also transverse to the railway line, in order to secure this moulding against horizontal displacement from the track.

Said moulding is thus locked onto the fastening elements so that it is secured against a horizontal movement away from the track. However, the said moulding remains movable again in particular in longitudinal direction along the rail.

However, if the said moulding is against both vertical upward movements, for example along the perpendicular, as well as against a horizontal movement away from the rail, for example transverse to the perpendicular and transverse to the track section, then there remains only a one-dimensional freedom of movement along the track, if desired. Thanks to a free movement along the rail, the corresponding mouldings can still be repositioned after securing in the track direction. As a result, such a moulding can be displaced more accurately to the position of the moulding secured to the same track facing it.

The present disclosure can further include a retaining means, in particular a support block or fixing bracket, at which at least one moulding is locked, which faces the moulding, secured by the fastener, on the other side of the same track, wherein the support means is secured to the fastening elements.

Said moulding is thus only indirectly locked to the support means. It is, however, locked directly to the support means, which is in turn secured to the fastening means. When the fastening means is designed as a fastening bolt, the support means can, for example, be attached under the bolt head of the fixing bolt when the bolt is tightened. The support means can have interventions, grooves, bores, hooks, or the like to lock the oblong securing device thereon.

By using a support means, the fastening means can be configured particularly simple, for example, as a standard bolt or a threaded pin. Further, the flexibility is increased in the construction of railway crossings. If desired, retaining means and facility for securing can, for example, be attached only to a few fixing bolts. It can be provided, for example, that the fixed mouldings at the mouldings facing the same track can have an integral multiple of the width of the fixed mouldings and are not locked to each fastening means.

In an embodiment of the present disclosure, at least one of the mouldings, which faces the moulding, secured by the fastener, on the other side of the same rail, has a longitudinal channel along the track section. Through the longitudinal channel, an oblong securing device is extended longitudinally along the track section and is locked in at least one direction to the fastening means. The oblong securing device can in particular be a rod, a tube, a wire or a rope. The longitudinal channel may be set up as a longitudinal bore through the respective moulding.

The oblong securing device can be locked to the fastening elements in a direction along the perpendicular thereby to prevent a movement in this direction and to secure the respective mouldings against being lifted out upward. The oblong securing device can be locked additionally or exclusively in a direction transverse to the perpendicular and transverse to the railway track section to prevent a movement in this direction and secure the respective moulding against horizontal shift away from the rail.

The oblong securing device can thereby be locked directly to fastening elements. An immediate securing can be implemented, for example, by the fact that the oblong securing device extends through the longitudinal channel of the corresponding moulding longitudinally along the track section and engages with the fastening elements. The fastening elements can also be designed as a fastening bolt and can have a bolt head and engage the oblong securing device behind the bolt head so as to secure the body or the moulding with the longitudinal channel from a horizontal removal away from the respective rail. In place of a bolt head and a nut can occur, which is bolted onto a threaded pin.

In particular, the fixing bolt can have a special head with a groove and engage the oblong securing device in the groove of the special head of the fastening bolt to secure the moulding(s) with the longitudinal channel from a horizontal removal away from the respective rail.

It is also possible that the fastening bolt is set up as eye bolt with a ring head and engages the oblong securing device in the ring, in order to secure the moulding(s) with the longitudinal channel towards a lift out and against horizontal removal away from the respective rail at the same time.

The oblong securing device can also be indirectly locked to the fastening means. One only indirect securing on the fastening means can be implemented, for example, that the oblong securing device engages on the support means, which is in turn secured to the fastening means.

Further, a spacer can be included, which the bolt head of the securing bolt is bolted together on the track side facing the moulding that can be secured using the fasteners away from the rail web, when the fastening bolt is tightened and firmly bolted onto the threaded insert of the moulding. The support means can act as spacers when connected to the rail web.

In a further embodiment of the present disclosure, a first and second group of similar first and second track outer-side mouldings are included and a third group of similar intermediate-rail mouldings each. The mouldings each extend adjacent to one another side by side along the respective rail so that the first, third and second group of mouldings set up in a two-dimensional grid, the traffic area of the level crossing across the rails. The width of the traffic area of the railroad crossing corresponds to the width of the groups of each mouldings lying in the direction of the track.

A railway crossing built from groups of similar mouldings can be preferably set up in a desired width from a small number of different mouldings. Thereby, from the factory side only mouldings are to be fabricated with one or a few standard widths. Preferably, these widths are based on the threshold distance. It can, in particular, be envisaged to use mouldings whose widths are integer multiples ($n>=1$) of threshold distance.

The mouldings of a group are, therefore, disposed directly abutting each other in the track direction, while the first and third group as well as the third and second group of mouldings are separated from each other mouldings by the first and second rail. Preferably, each of the groups of mouldings comprise an equal number of mouldings. The two-dimensional grid of mouldings can, in particular, be a two-dimensional matrix.

In this embodiment of the present disclosure, for each moulding of one or two of groups at least one cross bore is envisaged through the associated rail web, wherein the cross bores are drilled with regular grid spacing through the rail web(s). Further, at least one fastening means, using which the respective moulding can be detachably fixed to the rail, is provided, wherein each fastening means extends through the respective cross bore in the rail web.

Those mouldings, for which a cross bore and a fastening elements are foreseen, can thus be secured or are secured in each case by a separate fastening means, for example, independent of one another, to the associated rail(s). Thus, these mouldings can be individually fixed in a preferred manner and also released again individually. This not only ensures excellent stability of the level crossing, but also allows a particularly easy maintenance. Thus, for example, mere some of the mouldings are removed so as to enable access to specific areas of the track bed, or only individual mouldings can also be exchanged without having to loosen other fixed mouldings.

Preferably, the mouldings of the group or groups of mouldings, which are not fixed with the fastening means through the respective cross bore in the associated rail web, have the same longitudinal channel, so that the oblong securing device extends through the longitudinal channel of all mouldings of this group and is locked to the fastening means in a direction along the perpendicular, in order to secure said group or groups of mouldings from being lifted upwards.

In other words, the group or groups of mouldings, which are not fixed with the fastening means through the respective cross bore in the pertinent rail web, have continuous longitudinal channels extending over the width of the group or groups, through which in each case a single or oblong securing device consisting of multiple parts extends, the length of which preferably corresponds to at least the width of the associated group. Such oblong securing device, which extends through several mouldings disposed side by side in the direction of the track, these mouldings are secured against vertical movement up and preferably, against a horizontal movement away from the rail. However, it is to be noted that these mouldings are preferably not coupled or connected to one another through the oblong securing device in the direction of the track. Rather, the mouldings remain movable in direction of the track, preferably independent of one another, like beads on a string.

The movement in the direction of the track facilitates that the corresponding mouldings can be repositioned after locking, for example, precisely at the position of the mouldings facing the same rail.

Basically, there are several ways to mount the three groups of mouldings. One possibility is to fix the first and second track outer-side mouldings at the first and second rail by means of fasteners through cross bores, in which the fasteners are connected by the rail inner sides through the cross bores with the track outer-side mouldings. The intermediate-rail mouldings can then be secured with two oblong securing devices against upward lifting. Another preferred possibility is to fix the intermediate rail moulding at the first and second rail, wherein the fastening means are connected by the rail outer side through the cross bores with the intermediate-rail mouldings. The track outer-side mouldings can then be secured with a respective oblong securing device against being lifted upward.

Preferably, therefore, the intermediate rail mouldings with the fixings are fastened to either one rail or both rails through the cross bores in the bar rails and in each case an oblong securing device is extended through the longitudinal channel of the first and/or second track outer-side mouldings and is longitudinally locked at the respective fastening means in a direction along the perpendicular, in order to protect the first and/or second track outer-side mouldings from being lifted straight up.

In one embodiment of the present disclosure, the intermediate-rail moulding or the first and/or second track outer-side mouldings are supported on the rail foot of the respective rail.

These mouldings extend thus preferably in the rail in the vicinity of the rail head to the rail foot and are located on directly on the rail foot. This is especially the case with Vignol rails, whose rail is wider than the rail head. In this way, a high stability of the traffic area in the region close to the rails is ensured, in particular without additional components below the mouldings.

Preferably, at least one moulding that can be fixed by fasteners at its underside has recesses for the rail-foot securing device.

Under rail-foot securing device is understood the rail-foot mounting brackets and rail-foot fixing bolts, with which the rails are mounted on the sleepers.

Further preferably, at least one moulding with longitudinal channel on its underside has recesses for the rail-foot securing device as well as at least one recess for at least one fastener.

At least one recess for the fastener is preferably located at the underside of at least one moulding with longitudinal channel. Particularly preferred are the recesses for the rail-foot securing device and/or at least one fastener is designed, not continuously but discretely along the track section, so that the mouldings between the recesses reach in one piece up to the rail foot and are supported on the associated rail.

Seen in the track direction intermittently, the recesses are therefore envisaged, in particular, in the region of the rail-foot securing device or the fastener. This ensures a high stability of the traffic area in the vicinity of the rails is ensured.

The recesses are spaced from one another in the rail direction, on which the gaps correspond to rail-foot securing device or the fastening means. Typically, the recesses are thus spaced equidistant.

In an embodiment of the present disclosure, the intermediate rail mouldings, the first and/or second track outer-side mouldings do not intervene in the rail chamber which is set up between the rail head and the rail foot and do not fill out the rail chamber such that the intermediate rail moulding, the first and/or the second track outer-side mouldings can be vertically lowered during installation up to the rail foot from above without having to be arranged into the rail chamber.

Suitably, the intermediate rail moulding is arranged centred between the two rails and can be adjacent to both rails, thus completely fill out the space between the two rails substantially. The intermediate-rail moulding can also come to the inner sides of the two rails, but preferably only at the rail feet and rail heads, particularly preferred exclusively at the rail bases. In the rail chamber, the Intermediate-rail mouldings preferably do not intervene (or only minimal), so that it can be used (virtually) free of deformation between the rails from above and taken out upward. Further preferably, a track groove remains facing the rail head which can receive the flange of the train wheels. Also, the first and second track outer-side mouldings can come in contact with the outer side of the first or second rail, but preferably only at the respective rail foot and rail head. The track outer-side mouldings preferably do not intervene (or only minimally) in the rail chamber, so that the track outer-side mouldings can at least be inserted from above in the vicinity of the rail (virtually) free of deformation and taken out upward, wherein the moulding do not (or only minimally) intervene in the rail chambers, even relatively hard and rigid mouldings can be easily mounted and dismantled.

In an embodiment of the present disclosure, at least a chamber filling element is included, which fills out the rail chamber set up between the rail head and the rail base. Accordingly, the filler block elements are arranged between the rail web and the respective mouldings. The intermediate rail moulding, the first and/or second track outer-side mouldings thereby rest on the narrow side facing the rail at the chamber filling element.

While the rail chambers are filled out by the filler block elements, the soundproofing and the fixing of bordering mouldings, in particular transverse to the track direction can be further increased.

At least one filler block element is preferably made of rubber-elastic material, bonded rubber granules or vulcanized rubber. Further, the chamber preferably comprises at least one transverse channel, which is covered in the installed state with the one or more cross bores in the rail web, so that the fastening means extends through the transverse channel of the filler block element and through the cross bore in the rail web, when the moulding that can be attached to the securing device is attached to the rail.

The filler block element can, in particular, have a length corresponding to the width of a group of mouldings adjacent to one another arranged along the rail. Preferably, the filler block element then has a corresponding number of transverse channels, so that each moulding of a group can be secured with fastening means.

In one embodiment of the present disclosure, the moulding with the longitudinal channel has at least one recess, in particular on its underside, for at least one fastening means and the moulding with the longitudinal channel engages behind a bulging portion of the fastening means, for example, the bolt head, in order to lock the moulding with the longitudinal channel on the securing means transversely to the track section when the moulding is assembled with the longitudinal channel of the rail.

In a further embodiment of the present disclosure, the moulding with the longitudinal channel has at least a recess, in particular on its underside, for at least one fastening means and at least one recess is configured custom-fit for at least one fastening means, in order to lock the moulding with the longitudinal channel at the fastening means longitudinally along the rail track when the moulding is mounted with the longitudinal channel on the rail.

In the case that at least a support means is included, at least one recess can be envisaged at the same time for at least one fastening means and at least one retaining means. It can also be provided that the moulding with longitudinal channel has an additional recess for at least one support means, which is configured custom-fit with the retaining means.

By securing a plurality of mouldings with longitudinal channel longitudinally along the track section by means of custom-fit recesses for the fastening means and/or the support means, each of these mouldings is locked independently of one another in a preferred manner. This ensures high stability of the level crossing.

Preferably, the intermediate rail moulding, the first and/or second track outer-side mouldings are fabricated from rubber-elastic material, bonded rubber granules, vulcanized rubber, wood, concrete, asphalt, or a combination made there from.

Particularly preferred is polyurethane-bound rubber granulates. The mouldings preferably have a dark colour, particularly dark gray or black.

Depending on the material, the threaded insert is preferably screwed in the material of the intermediate-rail moulding or moulded during fabrication, for example, the pressing of bonded rubber granulates into the material.

Further an intermediate-rail moulding or track outer-side moulding is provided for setting up the level crossing, which comprises a threaded insert on its side facing the narrow side, in order that intermediate rail moulding or track outer-side moulding is tightly bolted on the respective cross bore in the rail web.

Further, a method is provided, in order to build a railway crossing by incorporating a device as described. Here, at least an intermediate-rail moulding, at least a first and second track outer-side moulding and at least one fastening element is provided. Further, at least one cross bore is set up on site by the rail web of at least one of the two rails at the built-in rail. The intermediate rail moulding is placed between the two rails and the first and second track outer-side moulding are placed adjacent to the outer side of the first or second rail, wherein at least one of the mouldings is detachably fastened to an associated rail using the fastening means through the cross bore in the rail web of the rail. The mouldings are so placed that the first track outer-side moulding, the intermediate rail moulding and the second track outer-side moulding form the or a part of the traffic area of the level crossing across the rails.

In an embodiment of the method at least two fastening means are provided and are made of at least one cross bore through the rail web of each of the two rails.

In a first variant, after the fabrication of the two cross bores the intermediate-rail moulding is placed between the two rails and detachably secured on both rails by means of one of the fastening elements through the cross bore in the rail web of the respective rail. The first and second track outer-side mouldings are then placed adjacent to the outer side of the first and second rail.

In a second variant after the fabrication of the respective cross bore, the first and second track outer-side mouldings are placed adjacent to the outer side of the first or second rail and in each case detachably secured to the first and second rail by means of one of the fastening means through the cross bore in the rail web of respective rail. The intermediate rail moulding is then placed between the two rails.

In both variants, the first track outer-side mouldings, the intermediate-rail moulding and the second track outer-side moulding form a part of the traffic area of the level crossing across the rails.

In the first variant, it can be foreseen that at least a first and second provide track outer-side moulding with each having a longitudinal channel. These mouldings are placed adjacent to the outer side of the first or second rail so that the longitudinal channel longitudinally runs along the railway track, respectively, and thereafter secured against any lifting out upward, in which an oblong securing device is introduced in the longitudinal channel longitudinally along the track section and on which respective retaining means is engaged. In the second variant, it can be envisaged to make available at least one intermediate-rail moulding with two parallel longitudinal channels. This moulding is placed between the two rails, so that the two longitudinal channels run longitudinally along the railway track, and then secured against any lifting out upward, in which an oblong securing device is inserted in the two longitudinal channels longitudinally along the railway track and on which respective retaining means is engaged.

In an embodiment of the method, a first and second group of similar first and second track outer-side mouldings and a third group of similar intermediate rail mouldings, and at least one fastening means for each moulding of one or two of the groups is provided in each case. Further, at least one cross bore is produced for each moulding made of one or two of the groups by the associated rail web, wherein the cross bores are drilled with regular grid spacing through the rail web(s).

The mouldings of the first, third and second group are in each case are placed adjacent to each other side by side along the respective rail, thus setting up a two-dimensional grid in the traffic area of the level crossing across the rails. The width of the traffic area corresponds to the width of the groups of the mouldings lying side by side in the track direction in each case.

Further, each moulding is detachably secured by one or two of the groups at the associated rail using the respective fastening means through the respective cross bore in the rail web.

Use of a template can be foreseen so as to drill the cross bores with regular grid spacing through the rail web(s).

There is further provided a method for maintenance of a railway track in the region of a railway crossing, whereby the level crossing is set up by the device as described and/or has been established by the said method.

In the method for maintenance of railway track, if one or more secured mouldings are present to act against a lifting out upward, the secured moulding(s) acting against a lifting out upward are unlocked by removing the respective oblong securing device and removed from the rails, and preferably kept away from the rails. Further, the detachably fastened moulding(s) are disengaged from the associated rail by removing the respective fastening means, and also removed from the rails and preferably stored away from the rails. Thereafter, the maintenance of the track bed is carried out, for example, by stuffing the track bed in the area of the level crossing, in particular by means of a track tamping machine. Finally, the level crossing is again built according to the method as presented above, whereby, however, the fabrication of cross bore(s) can be dispensed with. Accordingly, the existing cross bore(s) can be re-used.

Generally, it is not absolutely necessary, that one or a plurality of the mouldings are secured by the rail web by means of cross bores.

It can be, for example, envisaged that a moulding is fixed directly to a rail, thus in particular not only to a sleeper, by means of a moulding holder fixed to a rail. In general, by using a fixing of a moulding, secured with a suitable additional component, directly on a rail, a particularly high stability of the traffic area can be ensured. As a result, particularly in the area close to the rail, a lifting upwards or jumping out of the moulding can be prevented, even if extreme loads can occur.

Therefore, a device for setting up, or forming, a level crossing is made available, which comprises at least a moulding and can be fastened either a moulding holder at least on one of the two rails or includes at least one cross bore through the rail web of at least one of the two rails, wherein the moulding at least one of the two rails either by means of the moulding-holder or by means of the cross bore can be detachably fixed to the rail. The moulding can thus be, in particular, fixed to one of the rails or locked. To the person skilled in the art it is understandable that this device, which is included both in the case that by means of a cross bore the moulding can be fixed to the rail, and in the case that a moulding holder is included, by means of which the moulding is fixed to the rail, can have interchangeable features and can be combined.

In particular, therefore, the moulding can be locked at the moulding holder in a direction along the perpendicular, for example vertical, in order to secure the moulding against being lifted out upward. Alternatively or additionally, the moulding body can be locked in a direction transverse to the perpendicular and transverse to the railway track, so as to secure the moulding against a horizontal removal away from the rail.

For this purpose, for example, it can be foreseen that the moulding has a longitudinal channel along the railway track, whereby an oblong securing device extends through the longitudinal channel longitudinally along the railway track and is locked at the moulding holder in a direction along the perpendicular and/or in a direction transverse to the perpendicular and also transverse to the track section, in particular by engaging the oblong securing device on the moulding holder. The moulding holder preferably comprises two holding clamps, which can be attached to the rail in juxtaposition to each other on both sides of the rail. In doing so, a moulding each can be fixed on both sides of the rail by means of the mouldings holder, more specifically, by means of the respective holding clamp. In other words, a holding clamp can be secured to the outer side of the rail and the other holding clamp to the inside of the rail. It is thus a moulding each can be fixed and/or locked on the outer and inner holding clamp so that a moulding is adjacent to the outer side of the rail and is fixed there, and the other moulding is adjacent to the inner side and is fixed there.

The two holding clamps, for example, the outer and the inner holding clamp, of the moulded part holder are preferably set up such that they embrace the rail foot. The holding clamps can also be braced to each other and/or with the rail, in particular the rail foot. For example, the holding clamps can be clamp-like fixed together so that the rail, in particular the rail foot, is clamped between the two holding clamps, when the moulding holder is attached to the rail. For clamping of the holding clamps, a clamping bolt can be provided, which appropriately runs below the rail foot transversely to the rail track and connects the two holding clamps with each other and is clamped.

The moulding holder can be designed as a rail anchor clamp which can be mounted in particular on the rail foot by bolting, wedging or clamping.

In an embodiment, the device comprises a total of at least two moulding holders, wherein on both rails each one of the two moulding holders is attached. The moulding holder comprises two holding clamps each. Further, a total of at least three mouldings are included. One of the mouldings is arranged between the two rails, for example, configured as an intermediate rail moulding, and fixed to both rails by means of both moulding holders, in particular of the two inner holding clamps of the two mouldings, fixed or locked. The other two of the mouldings respectively adjoin one of the outer sides of the two rails, for example, designed as track outer-side mouldings and are fixed to only one of the two rails are in each case by means of only one of the two moulding holders, in particular of the respective outer holding clamp.

Preferably, a first and second groups of mouldings adjoining one of the outer sides of the two rails in each case, for example, track outer-side mouldings, and a third group of mouldings arranged between the rails, for example, intermediate-rail moulding, are included, which extend side by side along the respective rail so that the first, third and second group of mouldings set up, in a two-dimensional grid, the traffic area of the level crossing across the rails, wherein the width of the traffic area of the level crossing can correspond to the width of the groups of the adjoining mouldings respectively.

It can then be foreseen that the mouldings have at least one of the groups having the same longitudinal channel, so that the oblong securing device extends through the longitudinal channel of all mouldings of this group and is locked to the moulding holder in a direction along the perpendicular, so as to prevent this group of mouldings from being lifted upwards.

In particular, in order to achieve high stability in the vicinity of the rails it can be envisaged that the moulding(s) are supported in the installed state on the rail foot of the respective rail. This can further be provided that the moulding(s) has/have the recesses at its lower side for the rail-foot securing device and/or at least one recess for the moulding holder.

The recesses for the rail-foot securing device and/or the moulding holder need not be set up continuously along the track route. In particular to increase the stability or to provide a suitable longitudinal channel, it can be foreseen that the recesses are set up discretely along the track section, so that the moulding(s) are adequate between the recesses as mono-block up to the rail foot and are supported on the associated rail.

In particular, the recess for the moulding holder can be set up custom-fit to the moulding holder, so as to lock the respective mouldings to the moulding holders longitudinally along the track section when the respective moulding is fixed to the rail.

Further, a method of constructing a railway crossing with the following steps is made available:

- providing at least one moulding and at least one moulding holder, attaching the moulding holder to one of the two rails,
- placing the moulding between the two rails or adjacent to one of the outer sides of the two rails to form at least a part of the traffic area of the level crossing across the rails and
- detachably fixing the moulding to the rail by means of the moulding holder. In an embodiment of the method the following steps are provided:
- providing at least three mouldings and at least two moulding holders comprising in particular two holding clamps,
- fortifying the two moulding holders respectively on one of the two rails,
- placing one of the mouldings between the two rails and detachable fixing of this moulding using two moulding holders, in particular, the two inner holding brackets on both rails and
- placing two of the mouldings in each case adjacent to one of the outer sides of the two rails and detachable fixing of the two mouldings respectively by means of only one of the two moulding holders, in particular of the respective outer holding clamp, on one of the two rails.

The following describes the present disclosure by way of embodiments, and explained in more detail with reference to the figures, in which identical and similar elements are partly provided with the same reference numerals and the features of the various embodiments can be combined together.

BRIEF DESCRIPTION OF THE FIGURES

It shows:

FIG. 4*a*: a perspective view, FIG. 4*b*: a lateral view on a narrow side 20*a*, FIG. 4*c*: a lateral view of an end face 20*b*, FIG. 4*d*: plan view and FIGS. 4*e* and 4*f*: sections of FIG. 4*d* labelled planes C-C or G-G, FIG. 5*a*: a perspective view, FIG. 5*b*: a lateral view of a narrow side 30*a*, FIG. 5*c*: lateral view of an end face 30*b*, FIG. 5*d*: plan view and FIGS. 5*e* and 5*f*: sections of the planes D-D and F-F labelled in FIG. 5*d*, FIG. 6: various views of a filler block element.

FIG. 8*a*: a perspective view and FIGS. 8*b*, 8*c* and 8*d* are lateral views.

FIG. 17*a*: a perspective view, FIGS. 17*b* and 17*c* are lateral views and FIG. 17*d* a plan view, FIG. 18*a*: a perspective view, FIG. 18*b*: a lateral view of the side 22*c*''' away from the rail, FIG. 18*c*: a lateral view of the end face 22*b*''', and FIG. 18*d*: a sectional view of the plane E-E marked in FIG. 18*b*, FIG. 19: a sectional view of a railroad crossing in the region of a rail with a support block with spacer web, FIG. 20*a*: a perspective view, FIG. 20*b*: a plan view, FIGS. 1, 2 and 3 show a partially erected railway crossing for crossing a railway track. The railway track includes a pair of rails comprising a first rail 2 and a second rail 2', each having a rail foot 4, a rail head 6, and a rail web 8 interconnecting the rail head 6 and the rail foot 4. The two rails 2, 2' are fastened with rail-foot fixing bolts 10 and rail-foot mounting brackets 12, for example Vossloh brackets, on sleepers 14, in the present example of concrete sleepers.

DETAILED DESCRIPTION

Figure 1:
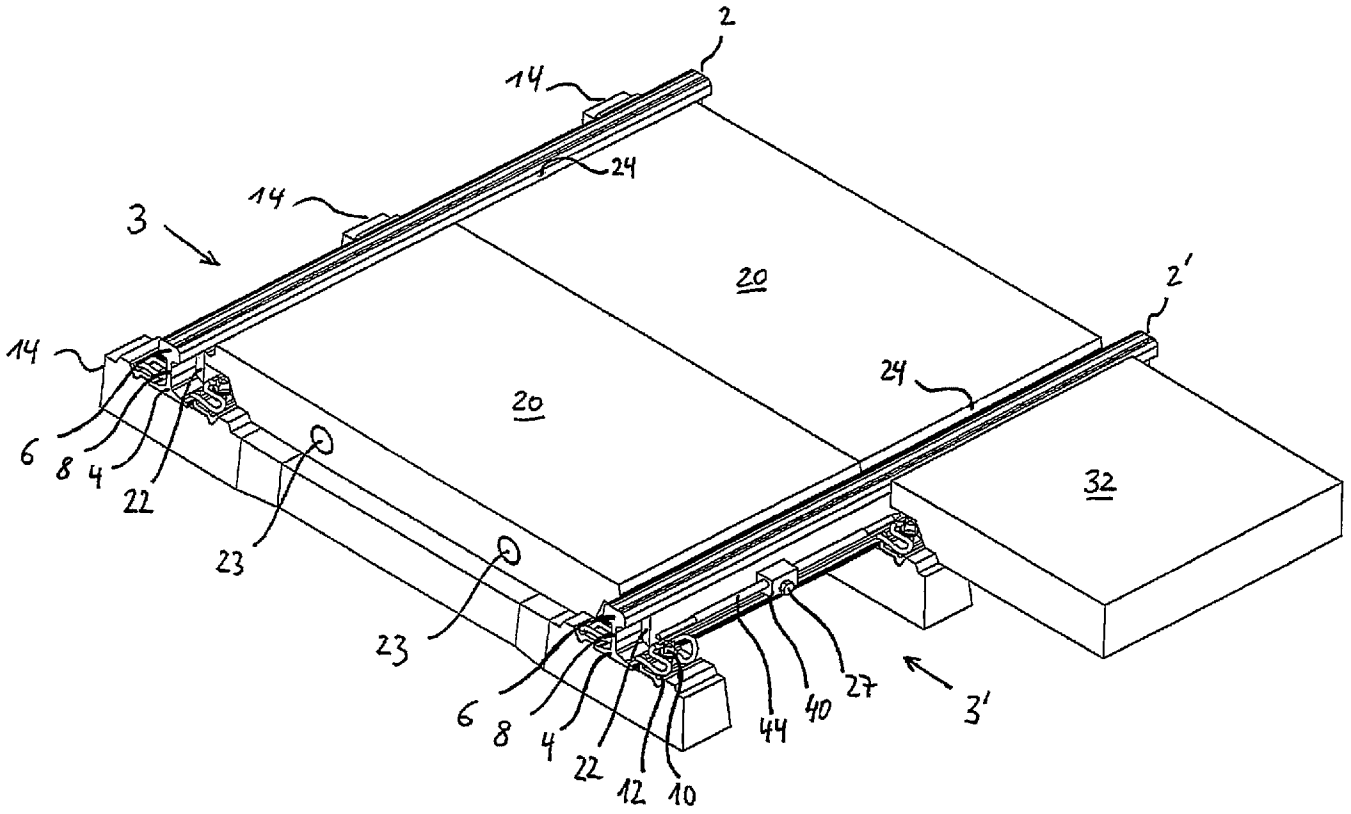
FIG. 1: a perspective view of a track section with partially set up railroad crossing.

As shown in FIG. 1, two similar plate-shaped intermediate-rail mouldings 20 are arranged between the two rails 2, 2', which are laid contiguously alongside one another along the rails 2, 2'. The intermediate rail mouldings 20 extend transversely to the track each of the first rail 2 to the second rail 2' and fill the space corresponding to the track width between the two rails substantially completely, although in the region of rail heads 6 lane grooves 24 are available for receiving the wheel flanges of the train wheels. The lane grooves 24 are, in this embodiment, designed as a fold or a groove at the edge between top side and the narrow side 20*a* lying opposite in the intermediate rail moulding 20. As can be seen in FIG. 3*b*, the intermediate rail moulding 20 rest on both rails 2, 2', in which the latter are supported on the rail feet 4 and contact the rail heads 6 in a linear fashion. The intermediate rail mouldings 20 are supported accordingly on the rail feet 4 of both rails 2, 2'. The intermediate-rail mouldings 20 themselves do not fill out the rail chambers formed between the rail heads 6 and rail feet 4 laterally of the rail webs 8, and do not rest on the rail web 8. Thus, the intermediate rail mouldings 20 can be inserted from top nearly distortion-free and pulled up again during dismantling.

The rail chambers are filled out in the illustrated embodiment with custom-fit filler block elements 22. The intermediate rail mouldings 20 rest on the respective filler block elements 20 with their narrow sides 20*a* facing the rails 2, 2' (see FIG. 4).

Figure 2:
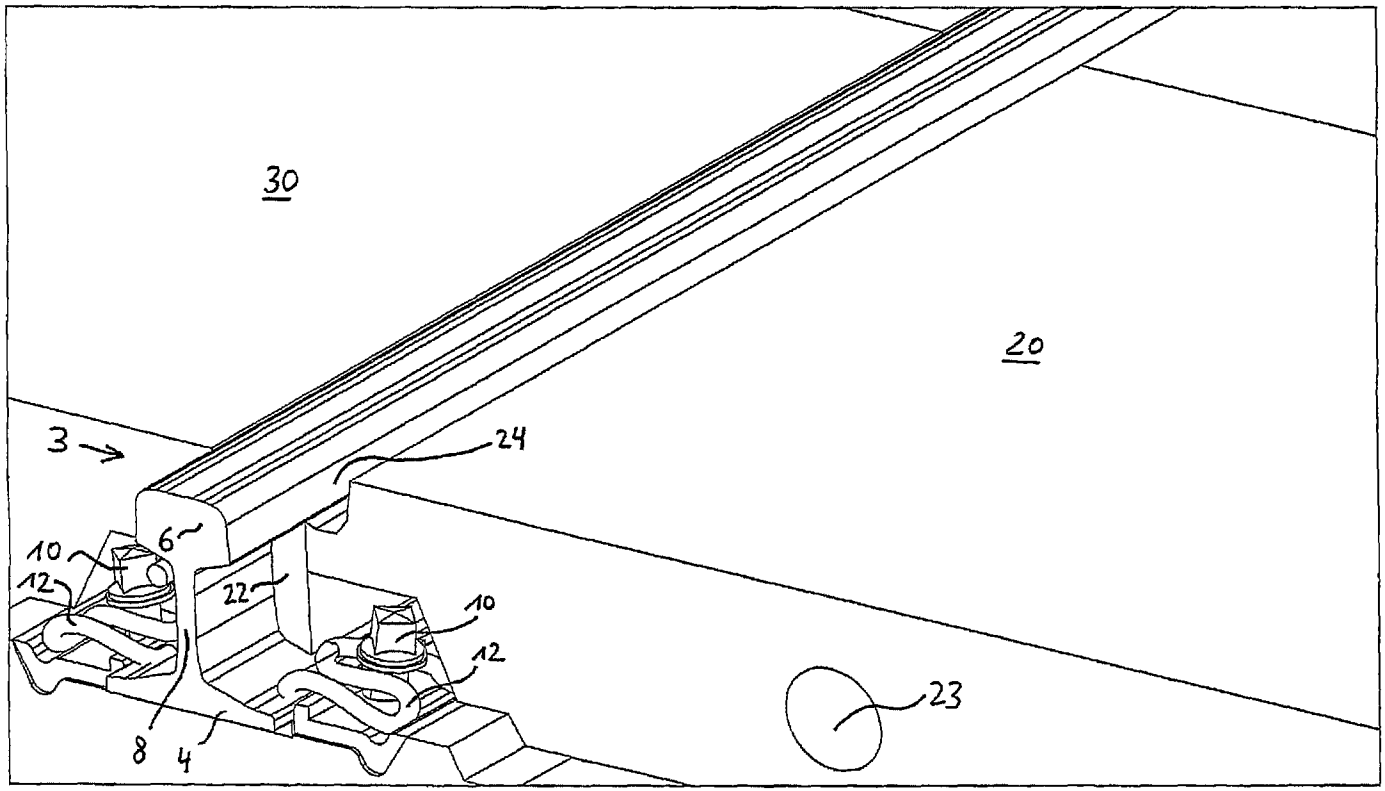
FIG. 2: a perspective detail view of a railroad crossing in the region of a rail.
Figure 3:
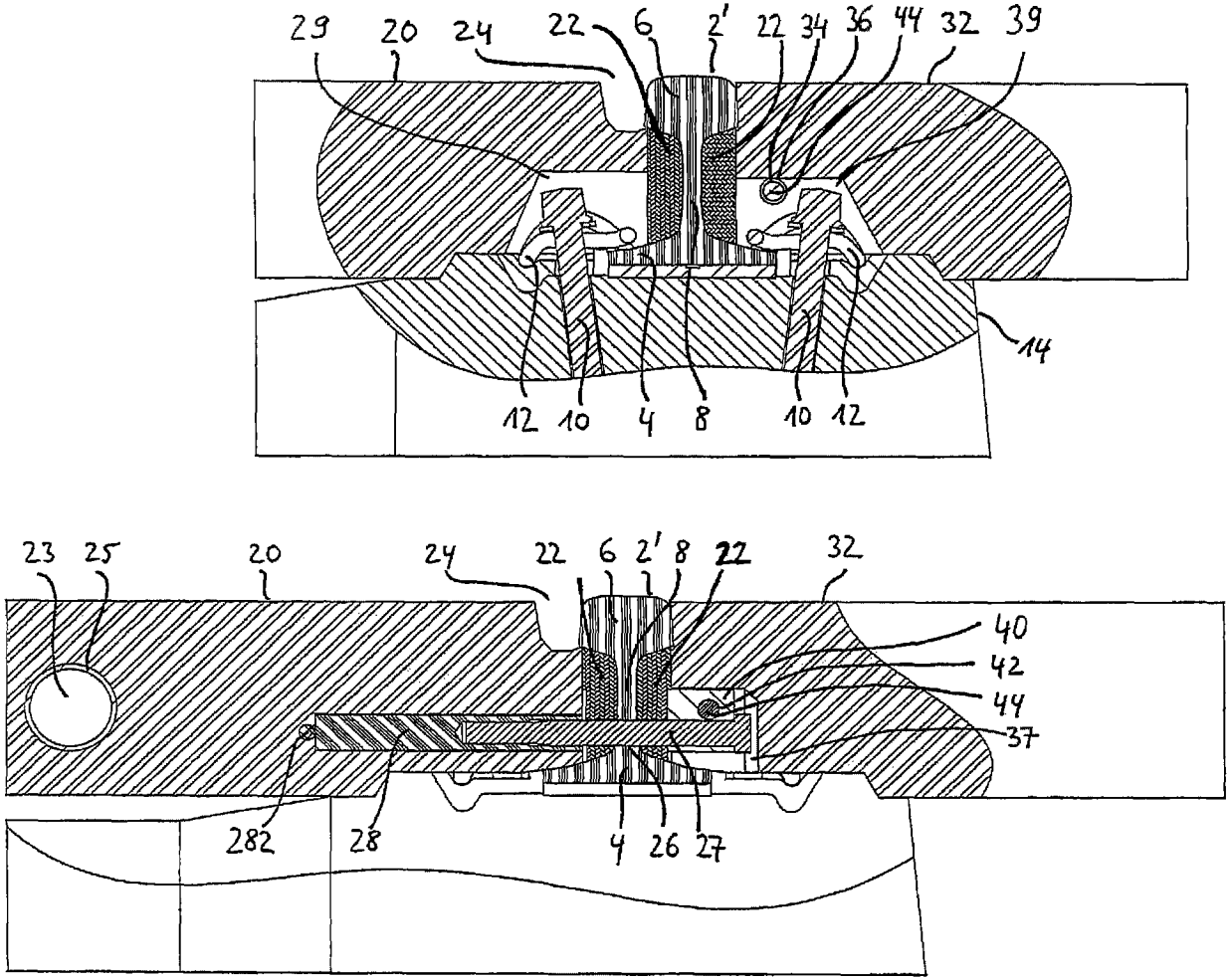
FIG. 3: two sectional views of a railway crossing in the region of a rail.

FIG. 2 further shows a first plate-shaped track outer-side moulding 30 (not shown in FIG. 1), which borders the outer side 3 of the rail 2. FIGS. 1 and 3 show a second plate-shaped track outer-side moulding 32, which is adjacent to the outer side 3' of track 2'. The rail outer side mouldings 30, 32 rest on the respective rails 2 or 2', in which these are supported on the rail feet 4 (the sections cannot be seen in FIGS. 3*a* and 3*b*) and touch upon the rail heads 6 from the external surface. The track outer-side mouldings 30, 32 are based on rail foot 4 of the adjacent rail. The rail chambers are again not filled by the track outer-side mouldings 30, 32, but by the filler block elements 22. In the example shown filler block element 22 are identical parts for the insides and outsides of the rails. But different filler block elements can be provided for.

As from the sectional view in FIG. 3*b*, it can be deduced that the cross bores 26 are present through the rail webs 8. In the example of FIG. 1, a plurality of cross bores 26 are located through the rail web 8 of each of the two rails 2, 2', which with respect to the longitudinal direction of the rails are arranged between the sleepers or a rail-foot securing device. In each of the rail webs 8 of the two rails 2, 2', the cross bores 26 are located in the direction of the track at the same positions. Thus, equal number of cross bores 26 are foreseen for crossing in each of the two rail webs 8.

Through the cross bores 26 the fastening bolts 27 extend perpendicular to the rail direction. The fastening bolts 27 are firmly tightened in the assembled state in horizontal threaded inserts 28 (see also FIG. 8), which are incorporated on the narrow sides 20*a* within the intermediate-rail mouldings 20 and thus face the inner sides of the rails 2, 2'. In doing so, the intermediate-rail mouldings 20 are each detachably but firmly bolted to two rails 2, 2'. The intermediate-rail mouldings are therefore fixed in the direction along the rail, in the direction along the perpendicular and in a direction transverse to the track and transverse to the perpendicular without play on the rails 2; 2. The intermediate rail moulding 20 are, therefore, secured to the rails 2, 2' by means of the fastening bolts 27 and in particular, in that they intervene deep into the rail chamber or engage under the rail head 6. The intermediate-rail mouldings are thus fastened directly to the rails 2, 2' and not only indirectly by a fixing to the sleepers.

In the illustrated embodiment, under the bolt heads, metallic support block 40 (see also FIG. 7) with support block—cross bores 41 and support block—longitudinal bores 42 are fastened on the fixing bolts 27, in which the fastening bolts 27 extend through the support block—cross bores 41. The support blocks 40 are horizontally braced transverse to the rail against the filler block elements 22, which are disposed in the outer rail chambers of the rails 2, 2'.

At the support blocks 40, the track outer-side mouldings 30, 32 can be indirectly locked to the fastening bolts 27. To this end, securing bars 44 extend longitudinally along the railway track through the support block longitudinal bores 42, as is obvious in FIG. 3*b*. Further, the securing bars 44 extend longitudinally along the track section through the longitudinal channels 34 (see also FIG. 5) of the rail outer side mouldings 30, 32, as shown in FIG. 3*a*. Referring to FIG. 3*a* in the longitudinal channels 34 of the track outer-side mouldings 30, 32, hollow tubes 36 are encased, in order to ensure a precise guide to the securing bars 44. In this way, the track outer-side mouldings 30, 32 are locked directly to the support blocks 40. The track outer-side mouldings 30, 32 are thus locked indirectly to the fastening bolts 27 in a direction along the perpendicular, so as to secure the mouldings 30, 32 against being lifted out upward. The track outer-side mouldings 30, 32 are thus locked indirectly on the respective fastening elements 27 in a direction transverse to the vertical and transverse to the railway track section, in order to secure against a horizontal removal away from the rail. The track outer-side mouldings 30, 32 are locked in this example by means of the securing bars 44, not longitudinal to the track path.

As shown in FIG. 3*b*, the cross bores 26 with respect to the height of the rail 2' extend in the lower area of the rail web 8. In the embodiment as shown, this results in the fact that the securing rods 44 and thus the longitudinal channels 34 of the mouldings 30, 32 are spaced from the bottom and top of the mouldings 30, 32, preferably on an average, the middle third run relative to the height of the mouldings 30, 32 and thus have enough moulded part material underneath so as to ensure the required stability. In the illustrated embodiment, the securing bars 44 run, namely, above the fastening bolts 27 extending through the cross bores 44.

However, other versions are possible. Thus, the cross bores 26 can extend, for example, through the middle or upper region of the rail webs 8 and the securing bars 44 below the fastening bolts 27. In this case, securing of the track outer-side mouldings 30, 32 directly to the fastening bolts 27 is facilitated, for example, without a support block 40, for example, in which the securing bars 44 engage under and/or behind the bolt head.

The partially constructed railway crossing, as illustrated in FIG. 1, is set up, in which a plurality of regular cross bores 26 spaced in the longitudinal direction of the rail are drilled through the rail web 8 of each of the two rails 2, 2'. The positions of the cross bores 26 on the rail webs 8 are preferably marked prior to drilling by means of a special drilling template (not shown) on the bar rails 8. Subsequently, the filler block elements 22 are mounted at the inner and outer sides of the rails 2, 2', whereby the transverse channels 220 cover the cross bores 26.

In the next step, the similar, intermediate rails mouldings 20 (of the third group) are placed between the two rails 2, 2', in which, for example, the latter are raised at the openings 23 with ropes or equivalent and lowered between the rails 2, 2'. The intermediate rail mouldings 20 are thereby placed between the rails 2, 2' such that the threaded inserts 28 located on the narrow sides 20*a* are covered with the cross bores 26 and that the two mouldings 20 lie adjacent to each other along the rails 2, 2'.

For each of the cross bores 26 the following process is followed: a support block 40 is mounted on the outer filler block element 22, so that its support block—cross bore 41 coincides with the transverse channel 220 of the filler block element 22. Then, the respective fastening bolt 27 is inserted through the support block—cross bore 41, through the transverse channel 220 of the outer filler block element, through the cross bore 26 in the rail web 8 and through the transverse channel 220 of the inner filler block element into the threaded insert 28 of the intermediate rail-moulding 20 and the intermediate-rail moulding is secured tightly and simultaneously the support block 40 is braced on the outer filler block element.

In the next step similar track outer-side mouldings 32 (the second group) are placed adjacent to the outer side of the second rail 2' so that the mouldings 32 lie adjacent to one another side by side along the rails 2' and longitudinal channel 34 faces the rail 2' running in these mouldings and extends longitudinally along the rail 2' (in FIG. 1, only one moulding 32 is shown). The track outer-side mouldings 32 are then locked against movement along the perpendicular and against movement transverse to the rail 2', in which the securing bars 44 are invasively inserted in the longitudinal channel 34 of the two mouldings 32 longitudinally along the rail track and in the retaining-block longitudinal bores 42 of the two associated support blocks 40. A plurality of securing bars 44 having a length shorter than the width of the level crossing can be sequentially inserted into the longitudinal channel 34 of a marginal moulding, which further push the previously introduced securing bars into the longitudinal channel 34. Thereby the two track outer-side rail moulding 32 are secured against lifting out upwards as well as against a horizontal removal away from the track 2'.

Finally, in an analogous manner, similar track outer-side mouldings 30 (of the first group) are placed adjacent to the outer side of the first rail 2 (shown in FIG. 2) and locked so that the first, third and second group of mouldings in a two-dimensional grid form a flat traffic area approximately at the height of the running surfaces of the rails 2, 2' across the rails 2, 2'. The width of the traffic area corresponds to the width of the groups of the mouldings lying adjacent in the track direction.

A built-up railroad crossing can be dismantled again in a simple manner. In the illustrated embodiment of FIGS. 1 to 3, the track outer-side-mouldings 30, 32 are unlocked to extract the securing bars 44. Then, the mouldings 30, 32 can be removed from the track. The detachably secured intermediate-rail moulding 20 can then be loosened by unbolting the fastening bolts 27 and are removed from the track. The ability to dismantle the level crossing facilitates exchange parts of the level crossing, for example, individual mouldings or to carry out maintenance work on the track bed in the area of the level crossing, in particular to plug the track bed. After such operation, the railway crossing can be rebuilt, whereby the cross bores 26, already present in the rail bar 8, are reused.

Figure 4:
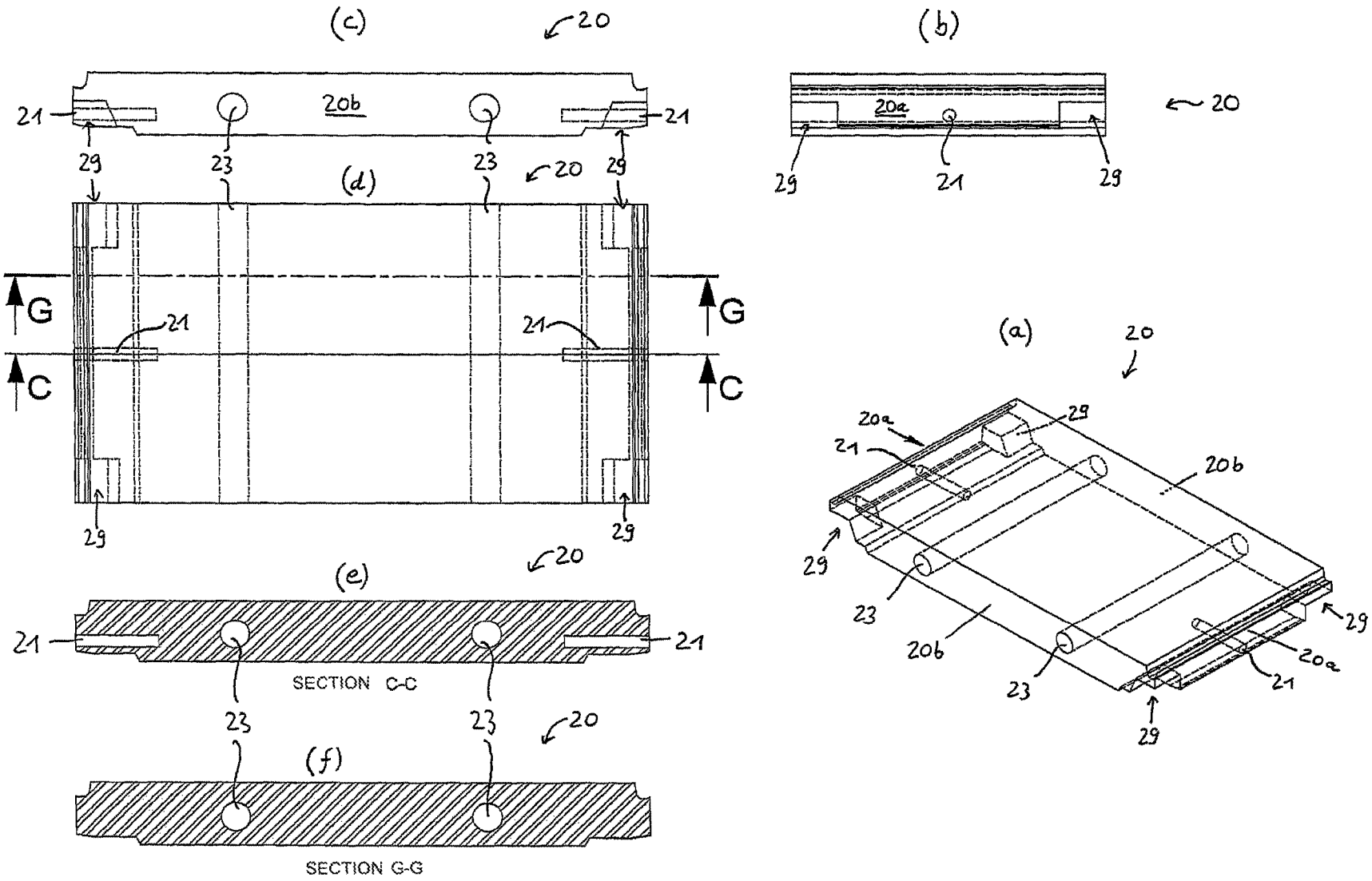
FIG. 4: various views of an intermediate rail moulding.

As indicated in FIG. 4, the intermediate rail moulding 20 has two narrow sides 20*a*, which face the rails 2, 2', when the moulding is incorporated. The moulding further includes two end faces 20*b* that are in the proximity of the adjacent mouldings when the moulding is incorporated. The moulding 20 has, on its bottom, recesses 29 which are inverted during installation from above over the rail-foot fixing equipment (see also FIG. 3*a*).

The recesses do not extend continuously along the width of the moulding 20, for example, along the rail in the installed state. Between the recesses, the moulding 20 extends, in the installed state, integrally on the rail foot 4 and is supported thereon.

In the narrow sides 20*a* facing the rail each have a horizontal receiving device 21, in particular, set up as a channel for a fastening means 27 and/or a threaded insert. Especially with elastomeric mouldings threaded inserts are factory set in the receiving devices 21. The threaded inserts can, for example, be bolted into the receiving devices 21 or can be formed already during production in the mouldings (see also FIG. 3*b*).

The width of a moulding 20*b* corresponds to the distance between the two end faces. Through the width of the intermediate-rail moulding 20 the openings 23 located can extend, to which the mouldings 20 can be for example, fastened with ropes or chains, in order to lift it. Within the openings 23, a hollow tube 25 can be surrounded, as can be seen in FIG. 3*b*. In a preferred manner, the moulding 20 is protected, when lifted, with a rope or chain from being damaged and, in addition, the moulding obtained an increased stability, which will enhance its load-bearing capacity, for example, when driving with heavy truck.

Figure 5:
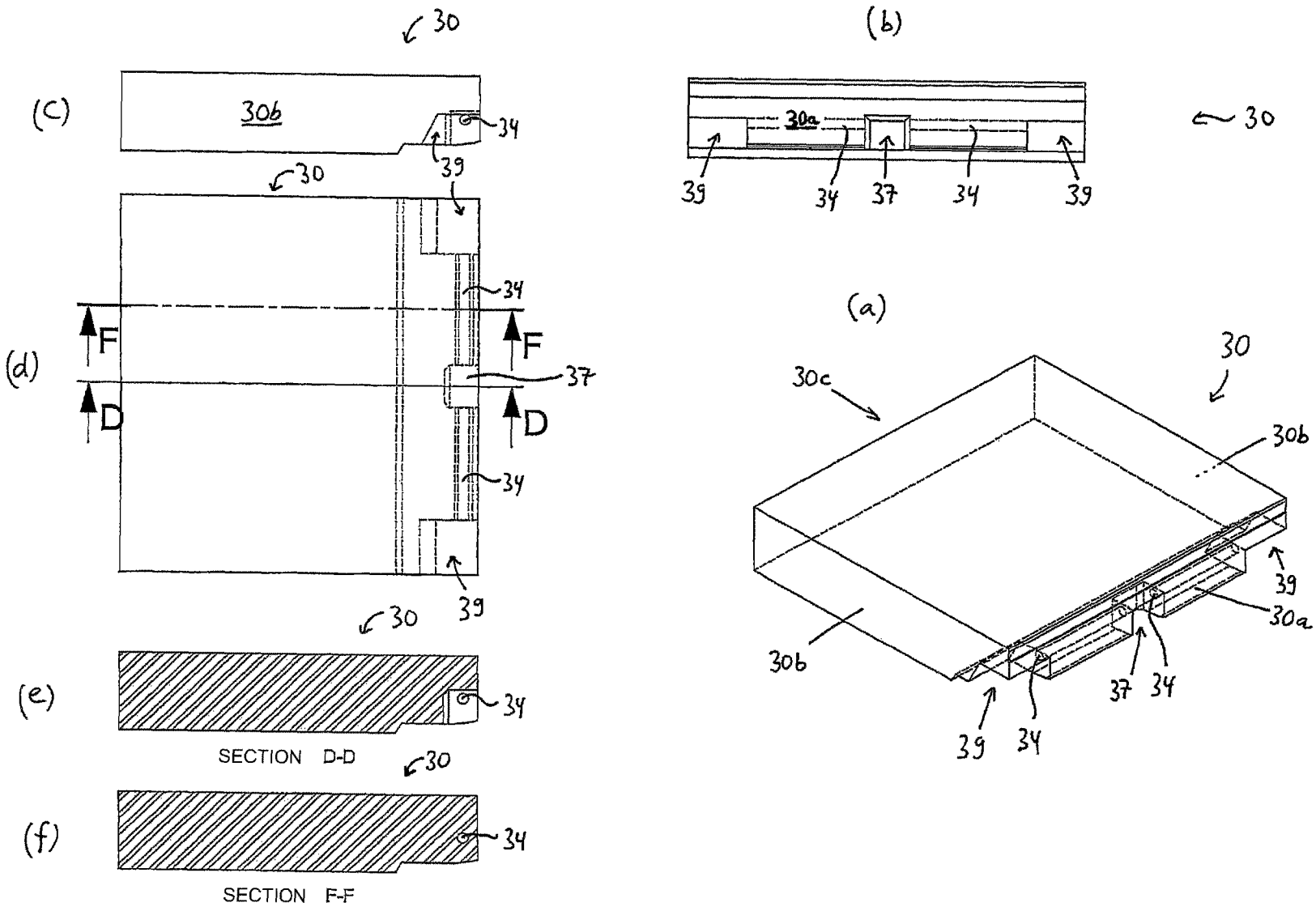
FIG. 5: various views of a rail outer side moulding.

As indicated in FIG. 5, the track outer-side mouldings 30 includes two narrow sides 30*c* and 30*a*, in which the narrow side 30*a* faces the respective rail 2 or 2', when the moulding is incorporated. The moulding further includes two end faces 30*b* that border the adjacent mouldings when the moulding is installed.

The moulding 30 has, on its underside, recesses 39 for the rail-foot fixing equipment and a recess 37 for the support block 40 and the fastening bolt 27 (see also FIGS. 3*a* and 3*b*). In this case, the recess 37 corresponds to the support block 40 and is measured to the fastening bolt 27. In the track direction, the recess 37 is set up custom-fit to the support block 40. Thereby, the track outer-side moulding 30 is locked in the installed state longitudinally along the track route.

Further, a longitudinal channel 34 extends through the track outer-side moulding 30, in which the safety bar 44 is inserted in order to lock the track outer-side moulding 30 to the support block 40.

Figure 6:
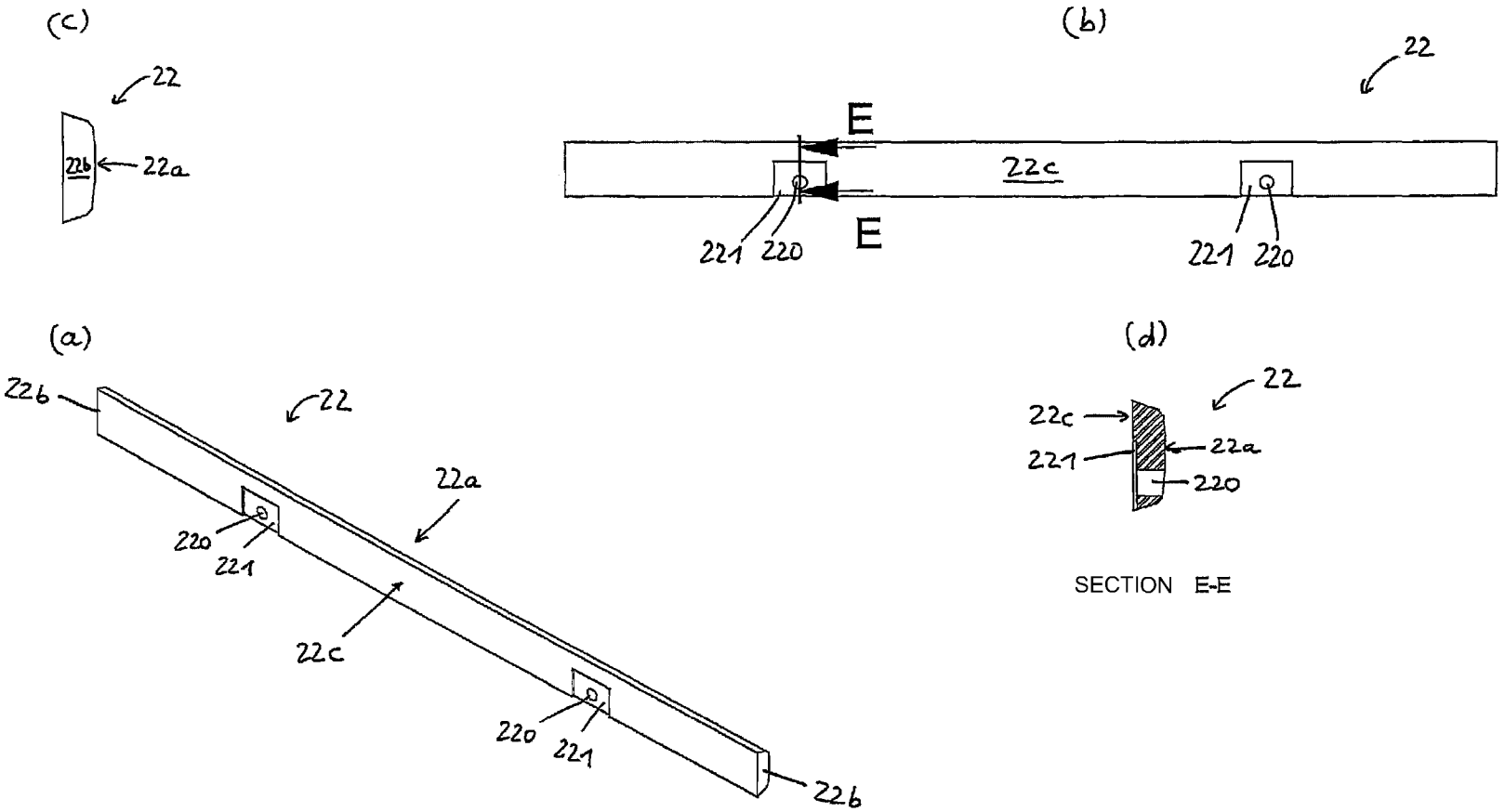
FIG. 6*a*: a perspective view.
FIG. 6*b*: a lateral view of the rail facing away from side 22*c*.
FIG. 6*c*: lateral view of the end face 22*b
* and FIG. 6*d*: a sectional view of the plane E-E marked E in FIG. 6*b*, FIG. 7: various views of a support block.

FIG. 6 illustrates a filler block element 22, which is provided for both the outer and the inner chamber of a Vignol rail 2 or 2'. The filler block element 22 is inserted with its rail-facing rounded side 22*a* into the rail chamber.

The side 22*c*, facing away from the rail, is essentially straight and faces the respective intermediate-rail moulding 20 or track outer-side mouldings 30 and 32 respectively. The side 22*c*, facing away from the rail, of a built-in filler block element 22 extends substantially flush with the side face of the rail head 6. The side 22*c*, facing away from the rail, also has recesses 221 for the support blocks 40. If more than one filler block element is used for a rail chamber, these abut with their end faces 22*b* to one another to form a continuous web.

In the present example, the filler block element 22, as shown, is longer than the mouldings and has in particular a length corresponding to the width of two mouldings 20 arranged longitudinally along the rail side by side. Accordingly, the filler block element 22 has a plurality, here two transverse channels 220 for fastening bolts 27.

Figure 7:
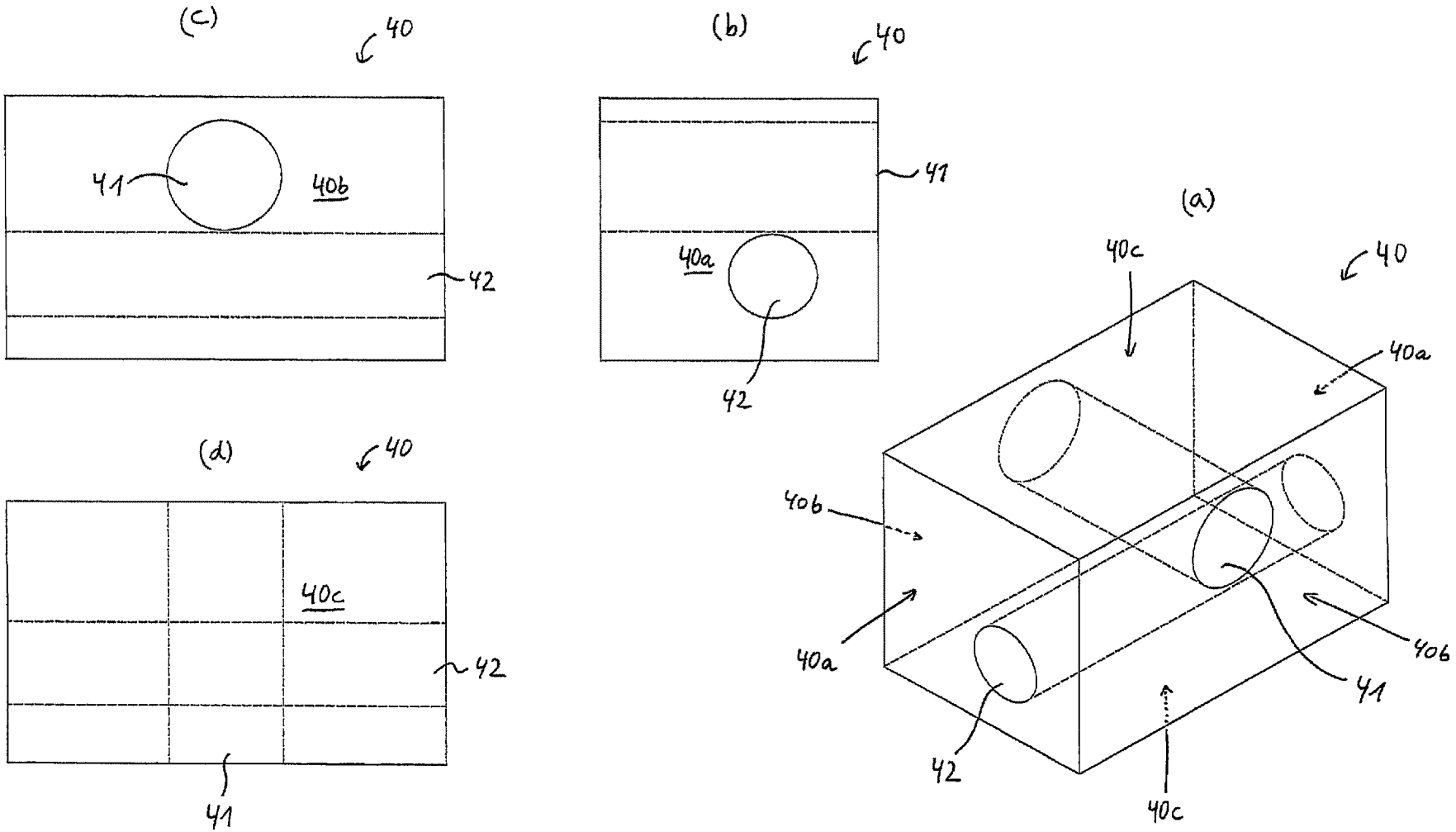
FIG. 7*a* a perspective view.
FIGS. 7*b* and 7*c* lateral views.
FIG. 7*d*: a plan view.

FIG. 7 shows a block—shaped support block 40 having a support block—cross bore 41 for the fastening bolt 27 and an orthogonal support block—longitudinal bore 42 for a securing bar 44. The support block—cross bore 41 runs through the side faces 40*b* and parallel to the side surfaces 40*a* and 40*c*, while the support block—longitudinal bore 42 runs through the side surfaces 40*a* and parallel to the side faces 40*b* and 40*c*.

As can be seen from FIGS. 7*b* and 7*c*, both bores 41 and 42 are spaced along the perpendicular to the side surfaces 40*c* to each other, thus not coplanar. Both bores 41 and 42 are thus offset from each other so that both bores can be penetrated by a fixing bolt 27 and/or a securing rod 44 at the same time.

Figure 8:
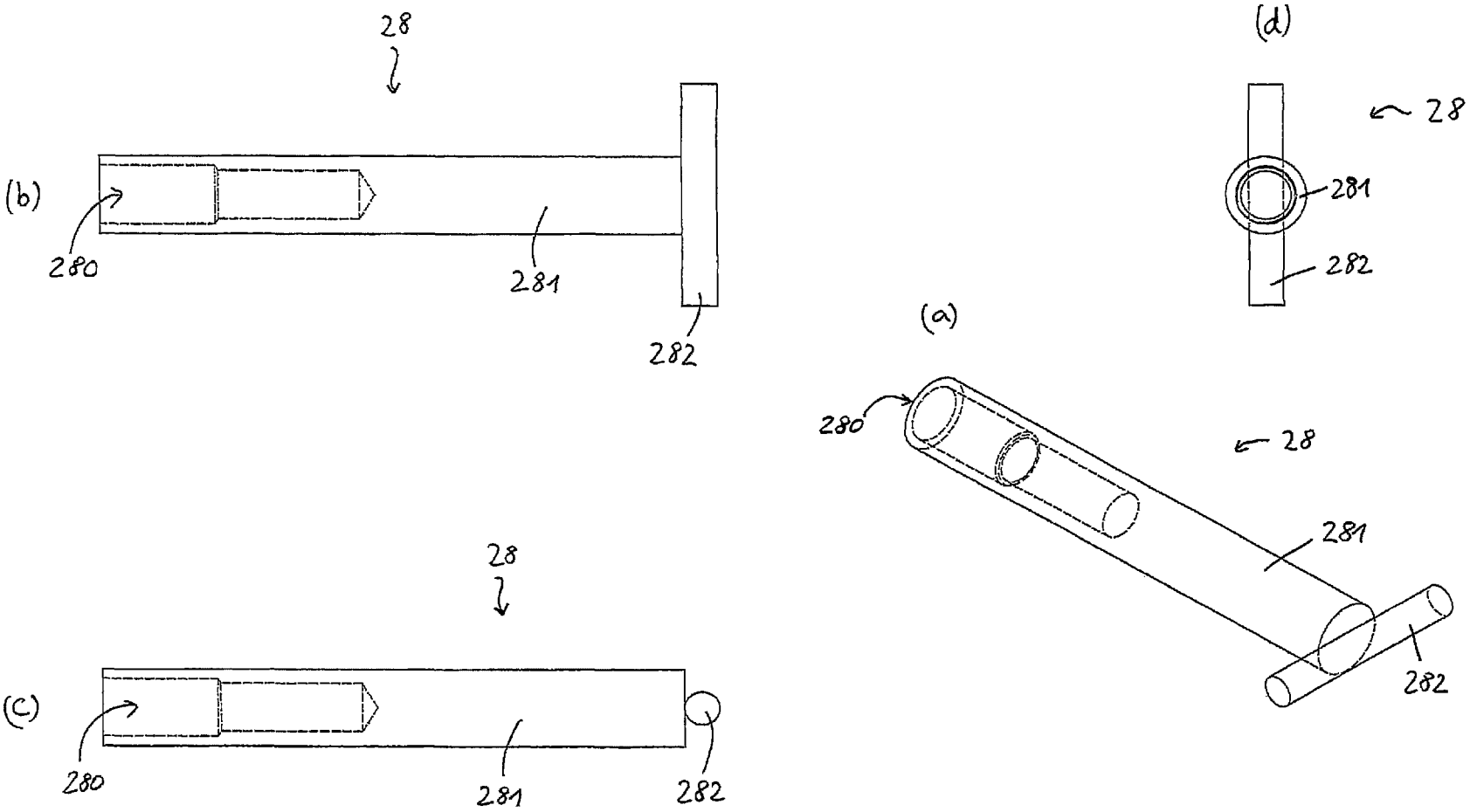
FIG. 8: various views of a threaded insert.

A support block 40, designed as a rectangular solid with two plane-parallel and side surfaces 40*a* running perpendicular in assembled condition, is preferred since a track outer-side moulding 30 can be passed with a cuboid-shaped recess 37 for mounting from the top at the support block 40 and is finally locked in the installed state with the corresponding inner sides of the recess 37 to the support block 40 in both directions along the rail. In the longitudinal direction of the rail, the recess 37 of the track outer-side moulding 37 is accordingly set up custom-fit to the length of the support block 40, defined by the distance of the two side surfaces 40*a*. FIG. 8 shows a threaded insert 28. Referring to FIG. 3*b*, a threaded insert 28 is incorporated at the factory in the rubber-elastic intermediate-rail moulding 20. The threaded insert 28 has an internal thread 280, in which the fastening bolt 27 is bolted. Further, the threaded insert 28 has a threaded sleeve 281 and an anchor element 282, which is set up in this example in the form of a cross bar. The anchor element 282 holds the threaded insert 28 in the moulding when the fastening bolt 27 is tightened and at the same time prevents rotation of the threaded insert 28 in the moulding.

Figure 9:
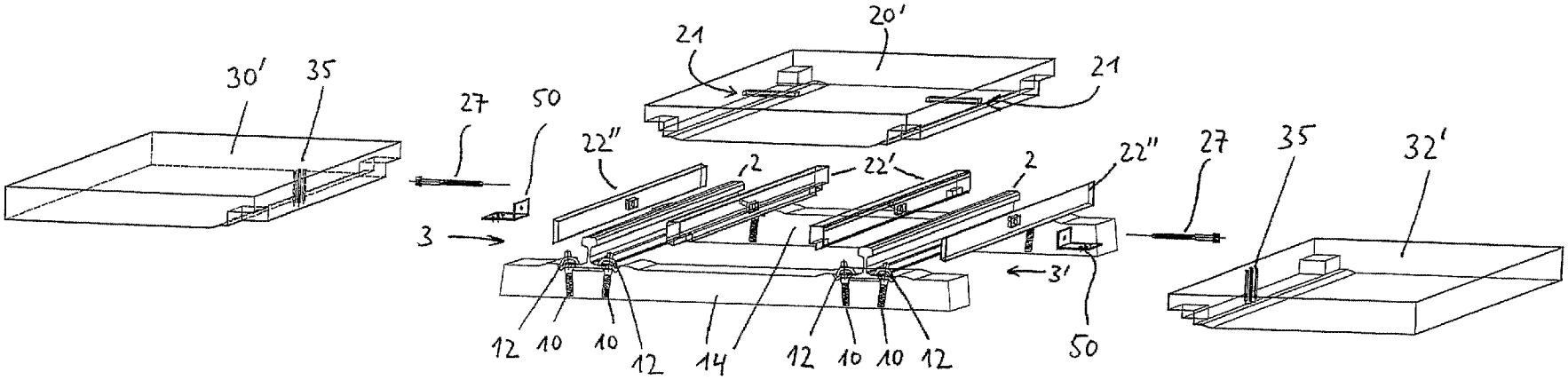
FIG. 9: an exploded view of a railway crossing, in a further embodiment.
Figure 10:
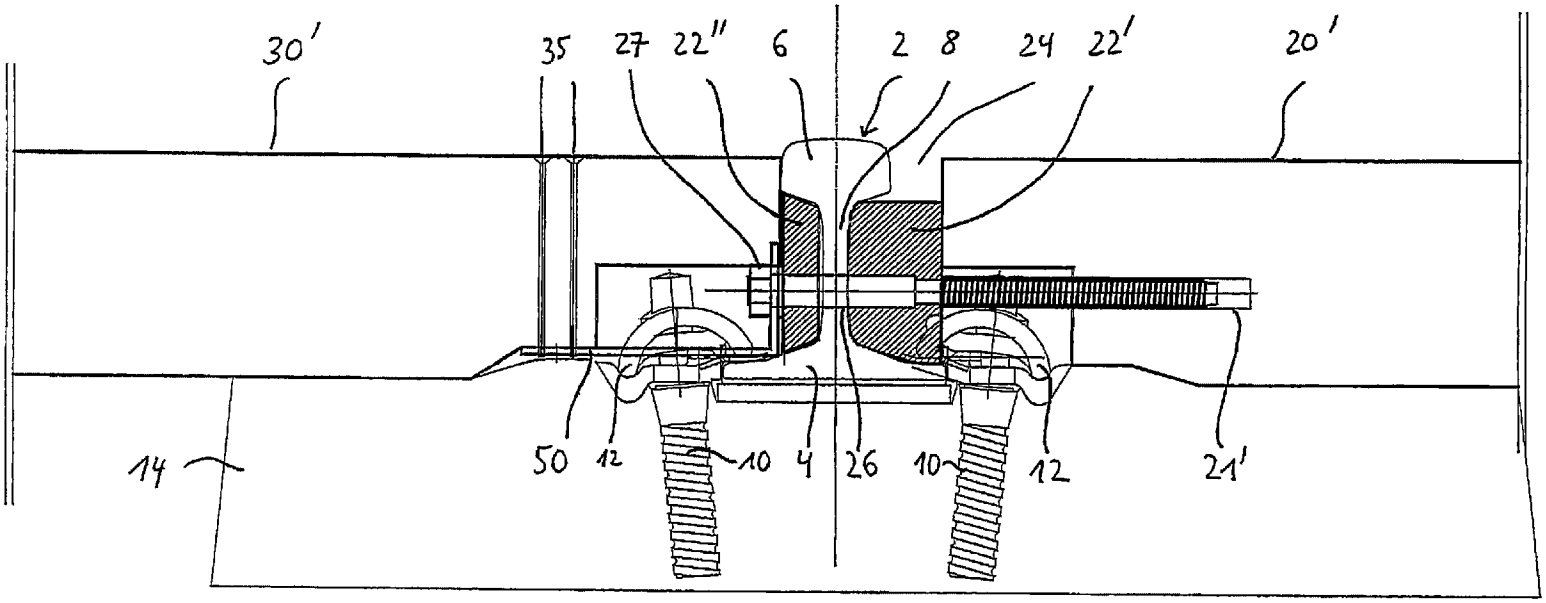
FIG. 10: a sectional view of a railroad crossing in the embodiment of FIG. 9 in the region of a rail.

FIGS. 9 to 14 relate to a further embodiment of a railway crossing. As shown in FIGS. 9 and 10, the level crossing in turn leads via a railway track having two rails 2, 2' mounted on sleepers 14'.

Figure 13:
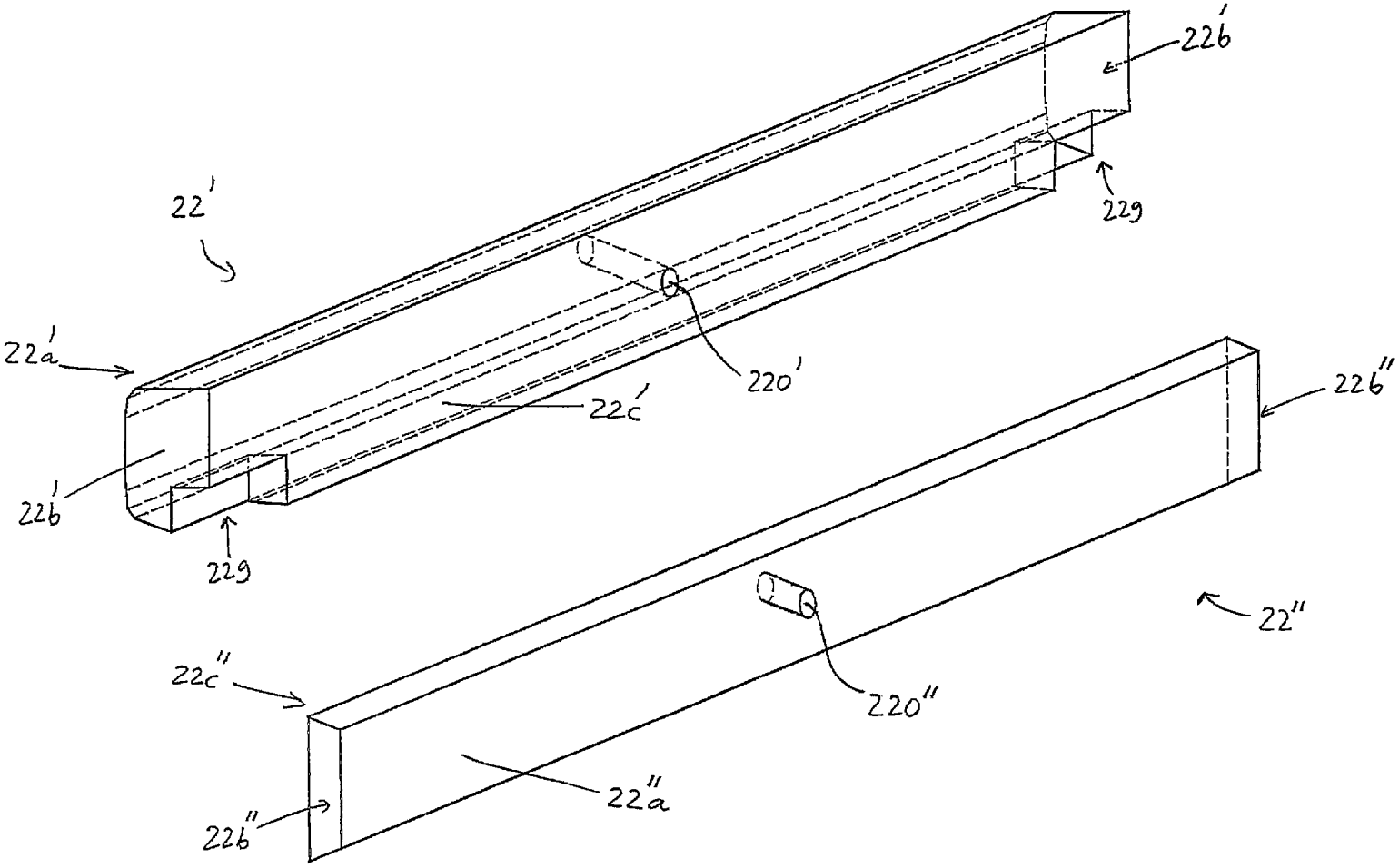

In this embodiment, the rail chambers on the inner sides and/or outer sides 3, 3' of the rails are respectively filled-out with different filler block elements 22' and 22" (see also FIG. 13). In particular, the flange-side filler block elements 22' for the rail inner side are wider than the rail chamber and thus extend horizontally out of the rail chamber.

Just as in the embodiment of FIG. 1, intermediate-rail moulding 20' and the track outer-side mouldings 30', 32' are arranged on the rails 2, 2', which are adjacent to the filler block element. In contrast to the embodiment in FIG. 1, the intermediate rail mouldings 20', which border the flange-side filler block elements 22', are spaced apart over their entire level of the rails 2, 2'. Accordingly, the track groove 24 is set up in this embodiment through the free space running beside the rail head 6 above the filler block element 22' on the rail inside. The intermediate rail moulding 20' thus does not affect the rail heads nor engages in the rail chamber.

As can be seen in FIG. 10, cross bores 26 are again provided through the rail webs 8 of the rails 2, 2'. Through the cross bores 26, fastening bolts 27 are bolted in the receiving devices 21' of the intermediate rail moulding 20'. Preferably, it is envisaged that threaded inserts are used in the receiving devices 21'.

In this embodiment, in the installed state by means of the fastening bolts 27, L-shaped brackets 50 (see also FIG. 14) are braced through bores 51 in the leg 50*a* of the bracket 50 against the track outer-side filler block elements 22". By means of the bracket 50, the track outer-side mouldings 30', 32' are indirectly secured to the mounting bolts 27. For this purpose, the track outer-side mouldings 30', 32' have vertical bores 35, in order to bolt these mouldings from above through the vertical bores 35 in the bores 52 of the legs 50*b* of the fixing bracket 50. in this way, the track outer-side mouldings 30', 32' are directly secured to the brackets 50 and indirectly to the fastening bolts 27. In contrast to the embodiment of FIG. 1, the track outer-side mouldings 30', 32' are thus secured by the support means in all directions, for example, in the direction longitudinal to the rail, in the direction along the perpendicular and in a direction transverse to the track and transverse to the perpendicular on the rails 2, 2' without play.

Figure 11:
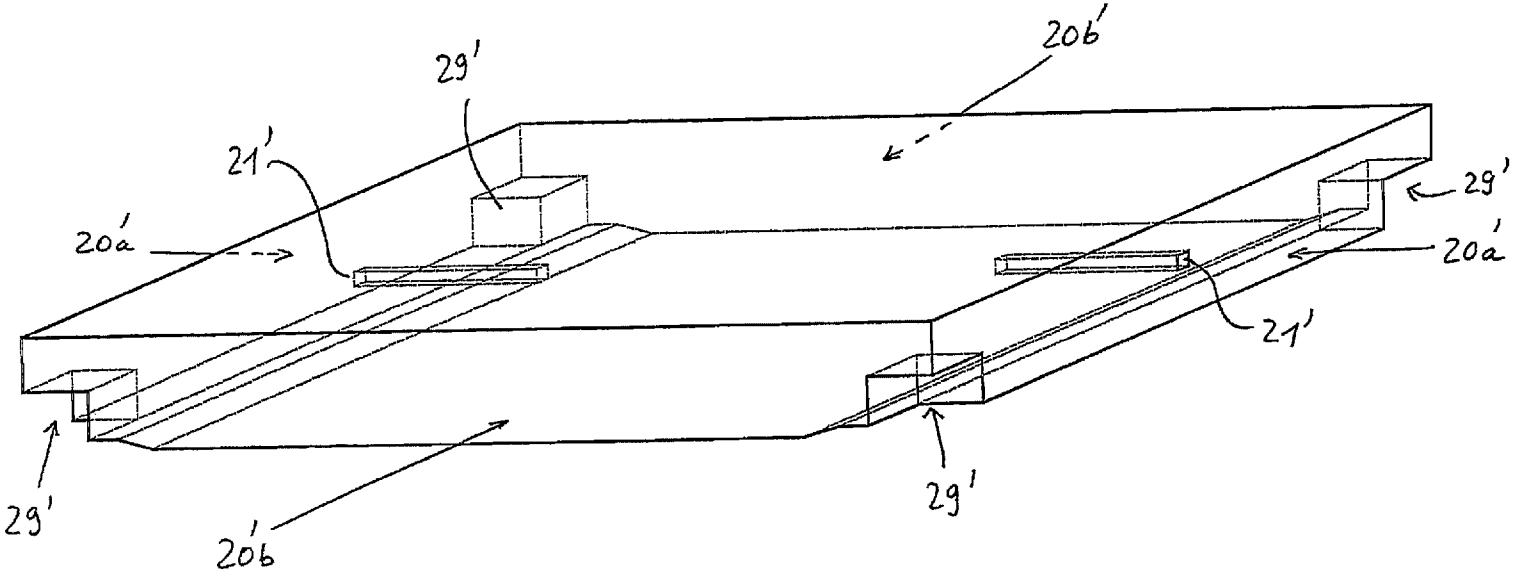
FIG. 11: a perspective view of an intermediate rail moulding in the embodiment of FIG. 9, FIG. 12: a perspective view of a track outer-side moulding in the embodiment of FIG. 9, FIG. 13: perspective views of two filler block elements in the embodiment of FIG. 9, FIG. 14: various views of a fixing bracket.

Referring to FIG. 11, the intermediate rail moulding 20' has two narrow sides 20*a*' and two end faces 20*b*'. The narrow sides 20*a*' face the rails 2, 2' when the moulding 20' is installed. The end faces 20*b*' can flank other mouldings 20', when the railway crossing in the longitudinal direction of the rails comprises a plurality of mouldings. On the underside of the moulding 20' are located the recesses 29' for the rail-foot fixing equipment. On the narrow sides 20*a*' is present in each case a receiving device 21' for a fastening bolt 27. As in the embodiment of FIG. 1, it can be envisaged that in the receiving device 21', a threaded insert or a dowel is incorporated or mounted.

Figure 12:
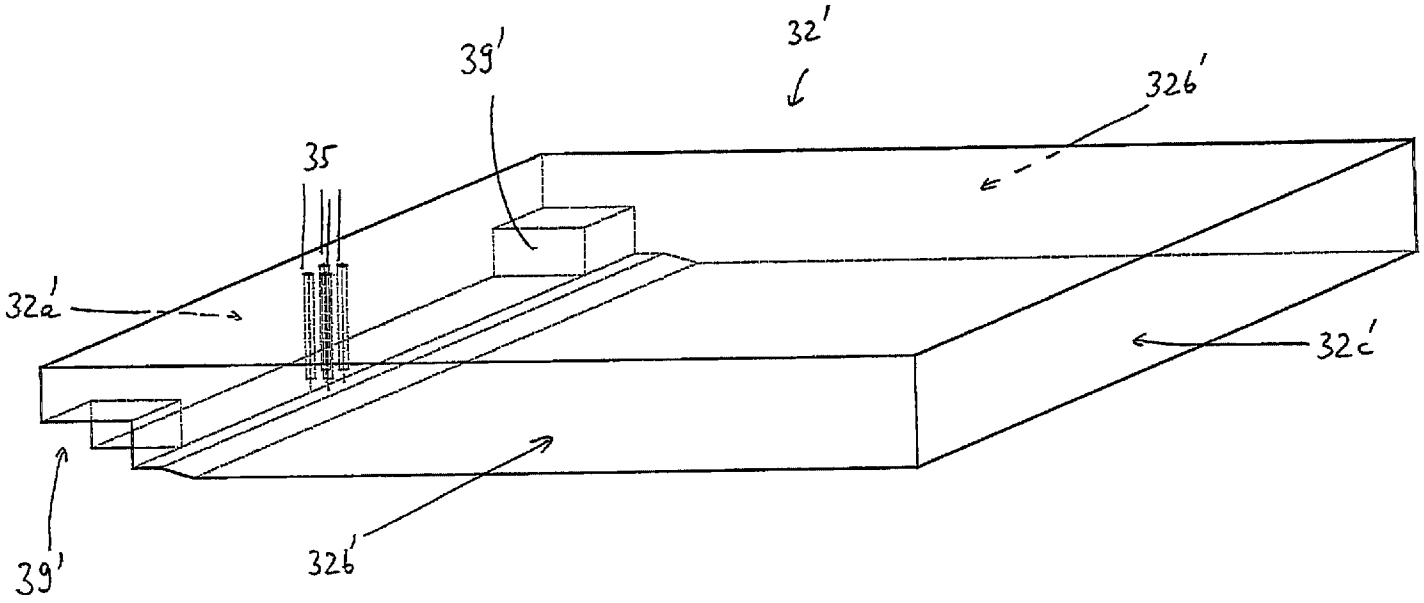

Referring to FIG. 12, the track outer-side mouldings 32' has two narrow sides 32*c*' and 32*a*', whereby the narrow side 32*a*' faces the respective rail facing 2 or 2', when the moulding is incorporated. The moulding further comprises two end faces 32*b*', which lie adjacent or fit closely to the neighbouring mouldings, if the moulding is installed. On its underside, the moulding 32' has recesses 39' for the rail-foot fixing equipment.

Further, one or more vertical bores 35 extend, in the example shown four pieces, through the track outer-side mouldings 32' in order to bolt the mouldings at the fixing bracket 50.

FIG. 13 illustrates two filler block elements 22' and 22", which are provided for the rail chambers on the inner sides or outer sides 3, 3' of the rails 2, 2'. In this embodiment, the filler block elements 22', 22" have a length that corresponds to the width of the adjoining mouldings. Accordingly, the filler block elements 22', 22" have only a transverse channel 220' and/or 220", through which the fastening bolts 27 can extend.

As can be seen from this example that rail facing sides 22*a*', 22*a*" of filler block elements 22', 22", rounded, can be designed custom-fit for the rail chamber, or polygonal approximated to the shape of the rail chamber. The track-remote sides 22*c*', 22*c*" are turned to the respective intermediate-rail mouldings or track outer-side mouldings and in both cases substantially straight.

The filler block element 22' for the inner sides of the rails is configured so wide that it protrudes sufficiently far from the rail chamber, in order to form the track groove 24 adjacent to the rail head 6. Because of its greater width, the filler block element 22' has further recesses 229 for rail-foot fixing securing device.

Figure 14:
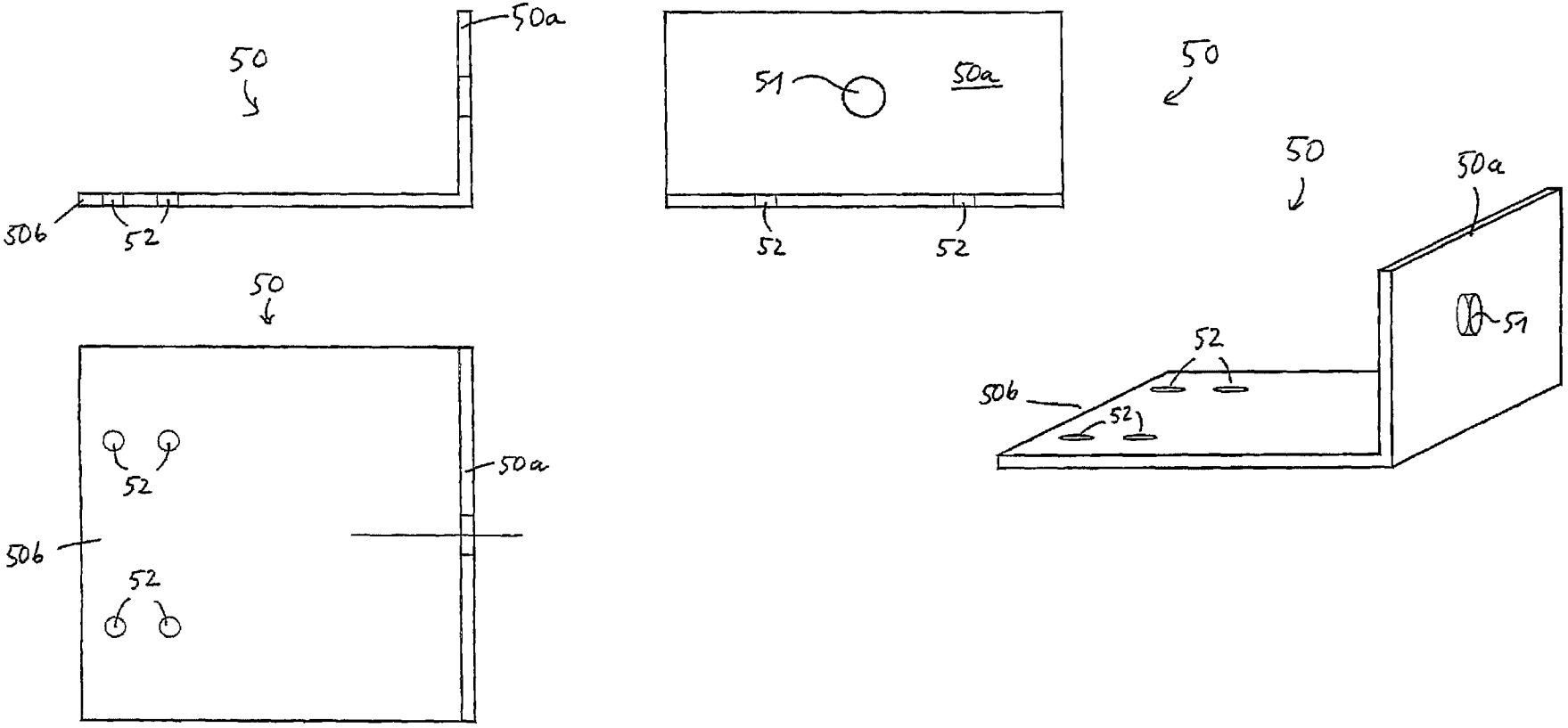

Referring to FIG. 14, the fixing brackets 50 each have a leg 50*a* with a bore 51, so as to secure the bracket 50 under the bolt head of the fastening bolt 27. In a leg 50*b* are located one or more, for example four bores 52 for screwing down the rail outer side mouldings 30', 32' through the vertical bores 35 at the brackets 50.

Figure 15:
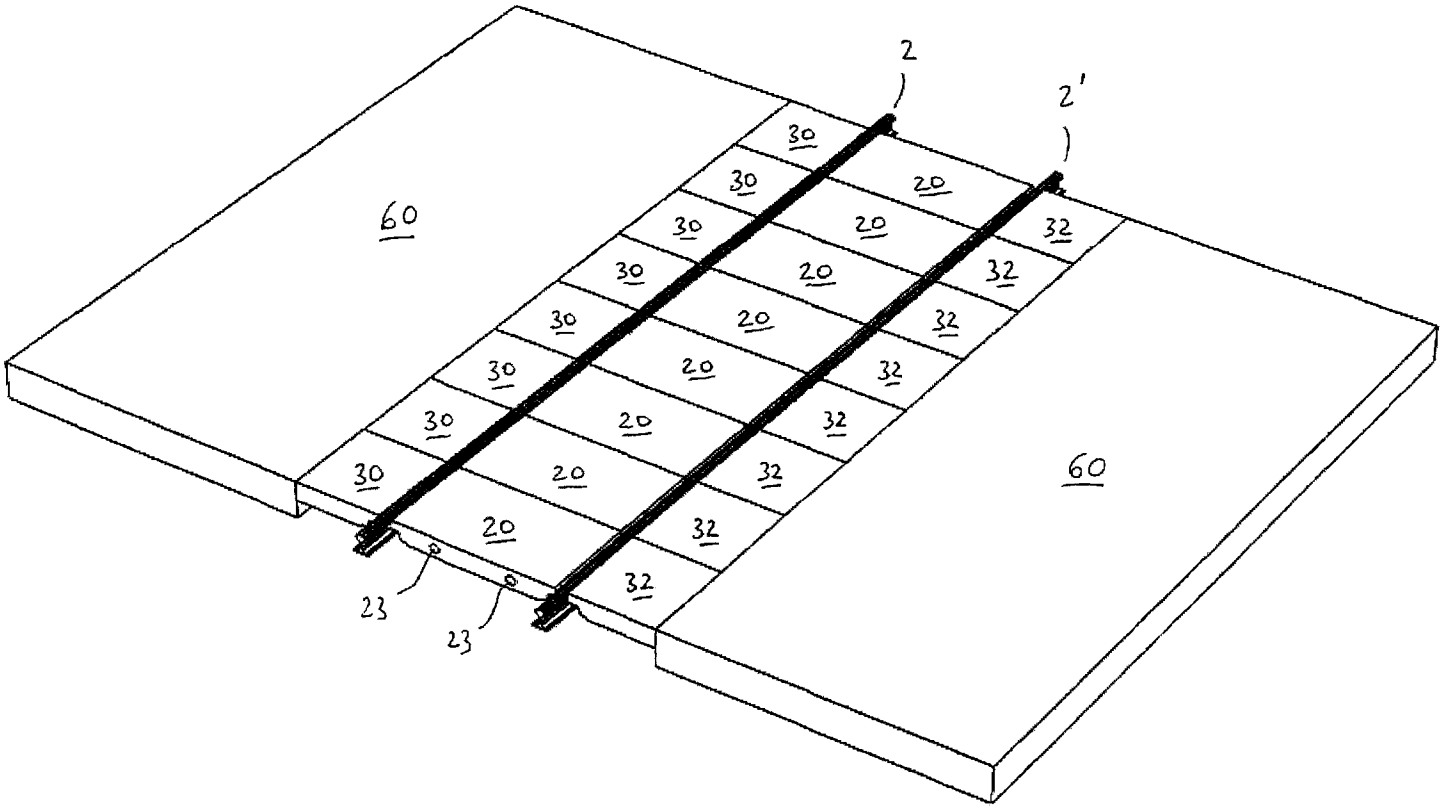
FIG. 15: a perspective view of a track section with erected railroad crossing.

Referring to FIG. 15, it can be foreseen that groups of similar mouldings are installed longitudinal to the direction of the track. Shown is a first and second group of respectively similar track outer-side mouldings 30 and 32 and a third group of similar intermediate-rail mouldings 20. A built-up railroad crossing can thus comprise a plurality of mouldings in the track direction so that the width of the level crossing is matched to the width of the traffic area 60, 60' cutting across the railway track. In the example of FIG. 15, eight mouldings per group are included, which abut directly against one another in the track direction. The track outer-side mouldings 30 of the first group, the intermediate-rail moulding 20 of the third group and the track outer-side mouldings 32 of the second group thus set up the traffic area of the level crossing across the rails in a two-dimensional grid.

Transverse to the track direction, a track configured as a pair of rails track can therefore be made passable through three plates, namely a first track outer-side moulding 30 adjacent to the traffic area 60, an intermediate rail moulding 20 and a second track outer-side mouldings 32 adjoining the traffic area 60.

The track outer-side mouldings 30, 32 are closed, in particular, to their track-remote narrow side on the asphalt of the traffic area 60 cutting across the rail network. The surface of the level crossing body set up by the moulding is essentially of same height to the traffic area 60 intersecting the area, so that the road users can easily pass through the level crossing.

Referring to FIG. 1, the intermediate-rail mouldings 20, as shown in FIG. 15, are secured with each two fastening bolts 27 through corresponding cross bores 26. Accordingly, for each intermediate rail moulding 20, a cross bore is available in each rail web 8 of the two rails 2 and 2'.

Referring to FIG. 5, the track outer-side mouldings 30 of the first group, as shown in FIG. 15, and the rail outer side mouldings 32 of the second group have the same longitudinal channel 34. When installed, a safety bar 44, whose length is adapted to the width of the level crossing, can extend through the longitudinal channels 34 of the mouldings group. But it can also be foreseen that several, in particular similar securing bars 44, which are shorter than the width of the level crossing, can extend through the longitudinal channels 34. The use of several shorter securing bars facilitates that the rods can be easily transported and assembled.

The track outer-side mouldings 30 are not clamped along the rail to one another but are each independently locked with their recesses 37 to the support blocks 40 against any displacement along the rail. The same applies to the track outer-side mouldings 32. The intermediate rail mouldings 20 are also not clamped to one another, but in each case independently fastened with fastening bolts 27 to the rails 2, 2'.

Figure 16:
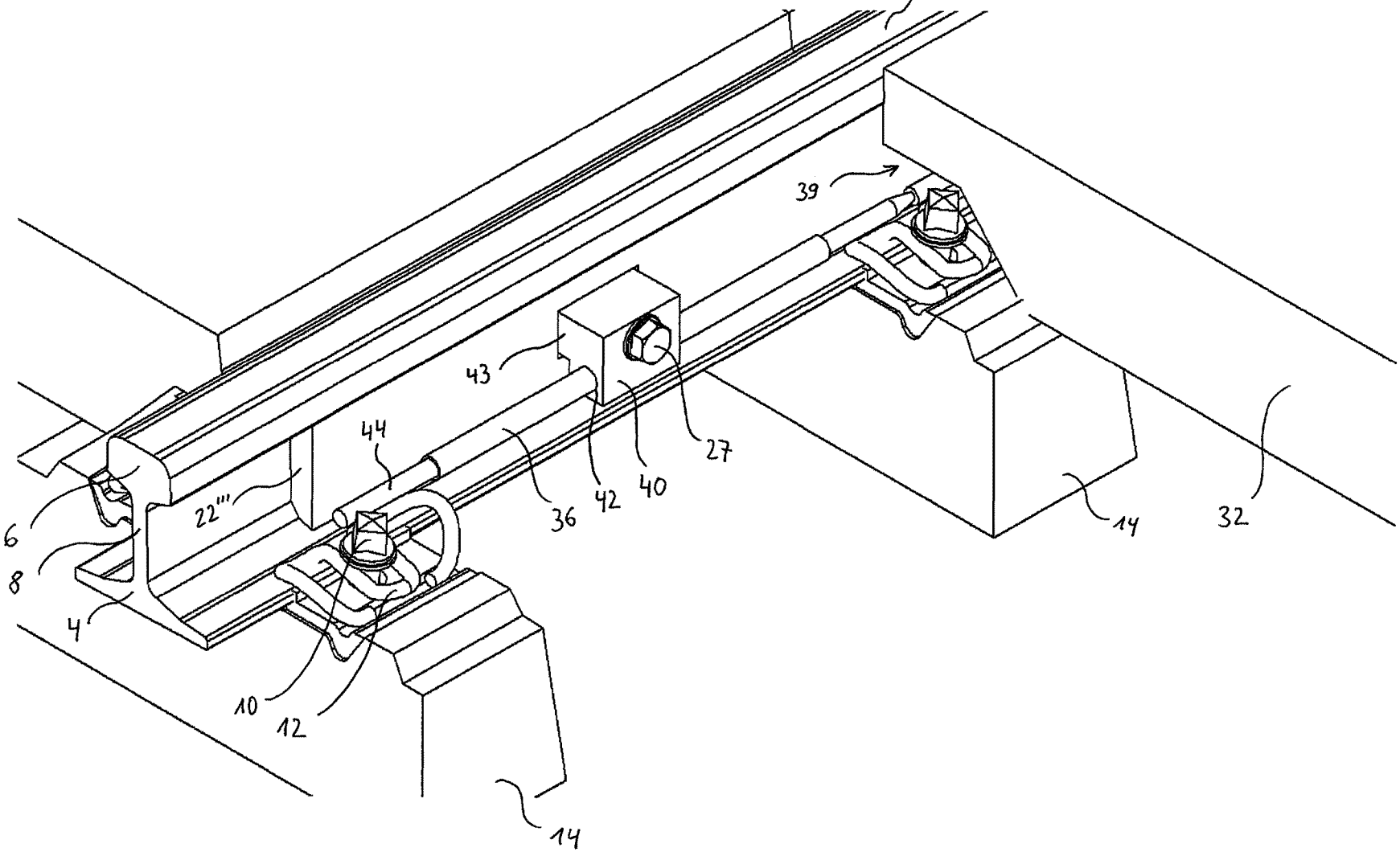
FIG. 16: a perspective view of a support block with spacer web in installed state.
Figure 17:
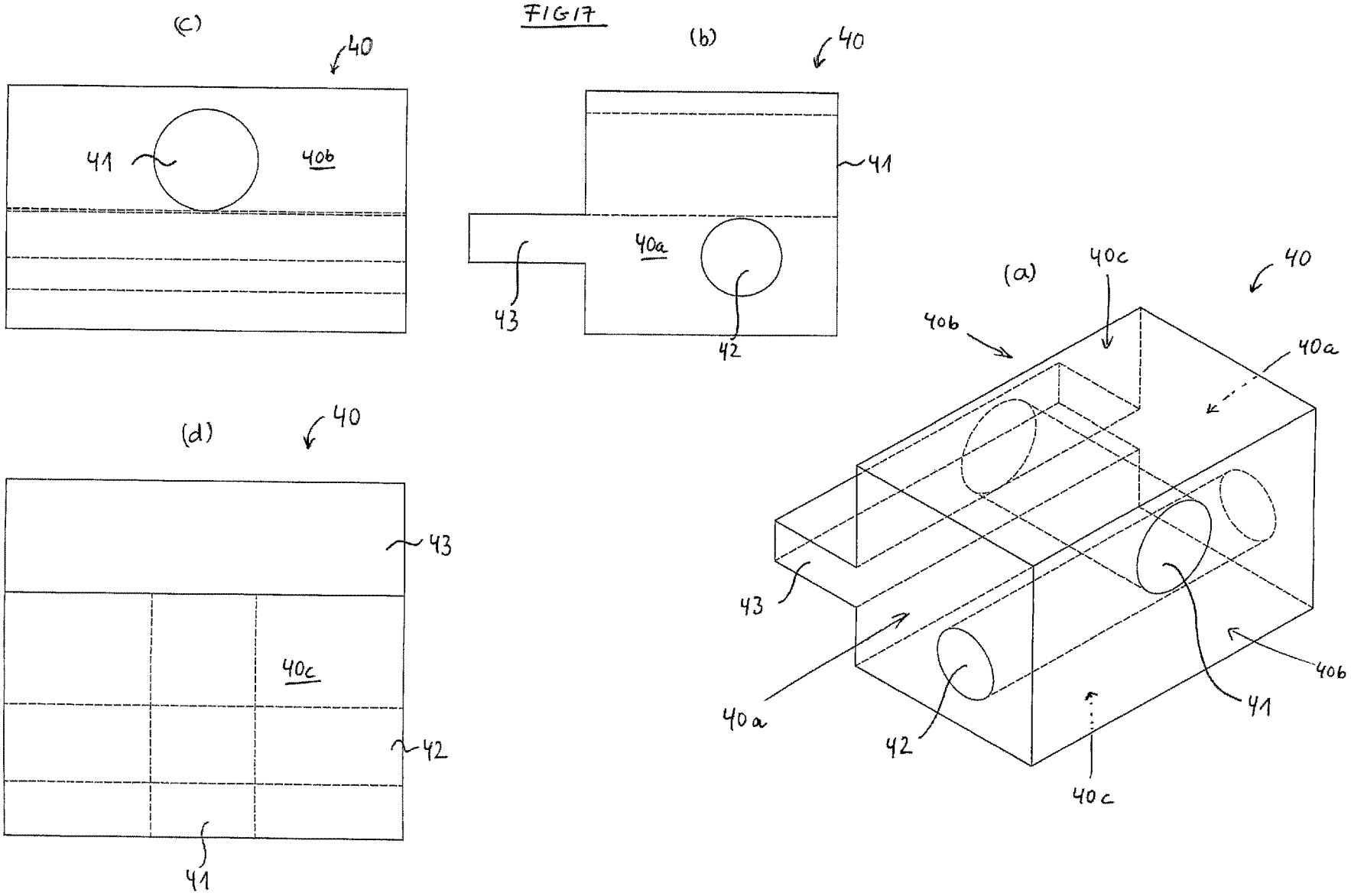
FIG. 17: various views of a support block with a spacer web.
Figure 19:
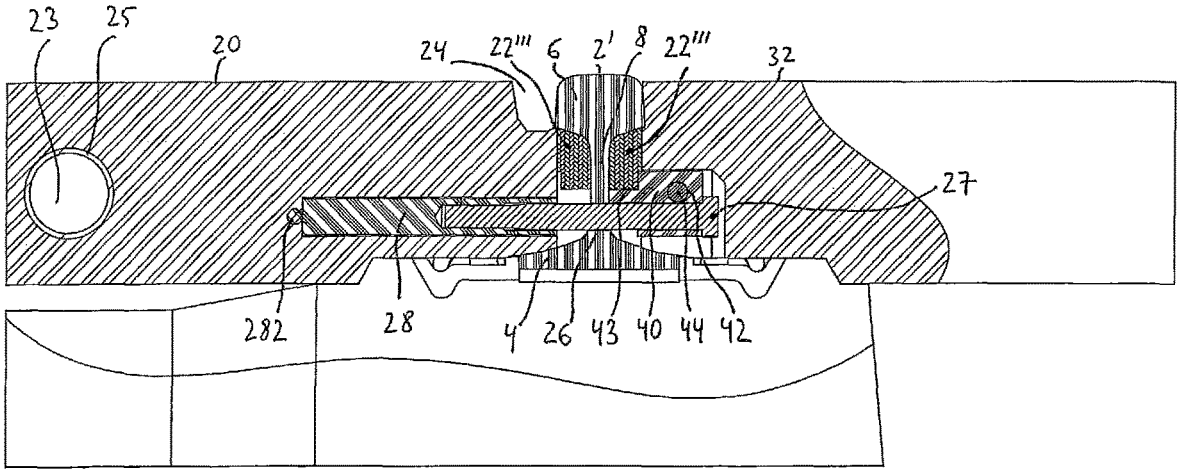

Referring to FIGS. 16, 17 and 19, the support blocks 40 can include a spacer web 43 adjacent to the rail web 8, which functions as a spacer. In this way, it can be prevented that the filler block element 22, on which the retaining brackets 40 are placed, are compressed and deformed when the fastening bolts are tightened. This also ensures that the longitudinal bores 42 in the support blocks 40 have a defined distance from the rail 2'. This is preferred, so that the inner diameters of the hollow tubes 36 enclosed in the track outer-side mouldings 32 cover precisely the longitudinal bores 42 in the support blocks 40, so that the securing rods 44 can be inserted easily.

Because the curves of the rail chamber can be different, a narrow spacing web 43 is specially suited to a support block 40. In this way, the spacer web 43 fits closely with only a small area and approximately centrally with respect to the height of the rail on the essentially straight centre piece of the rail web 8.

Figure 18:
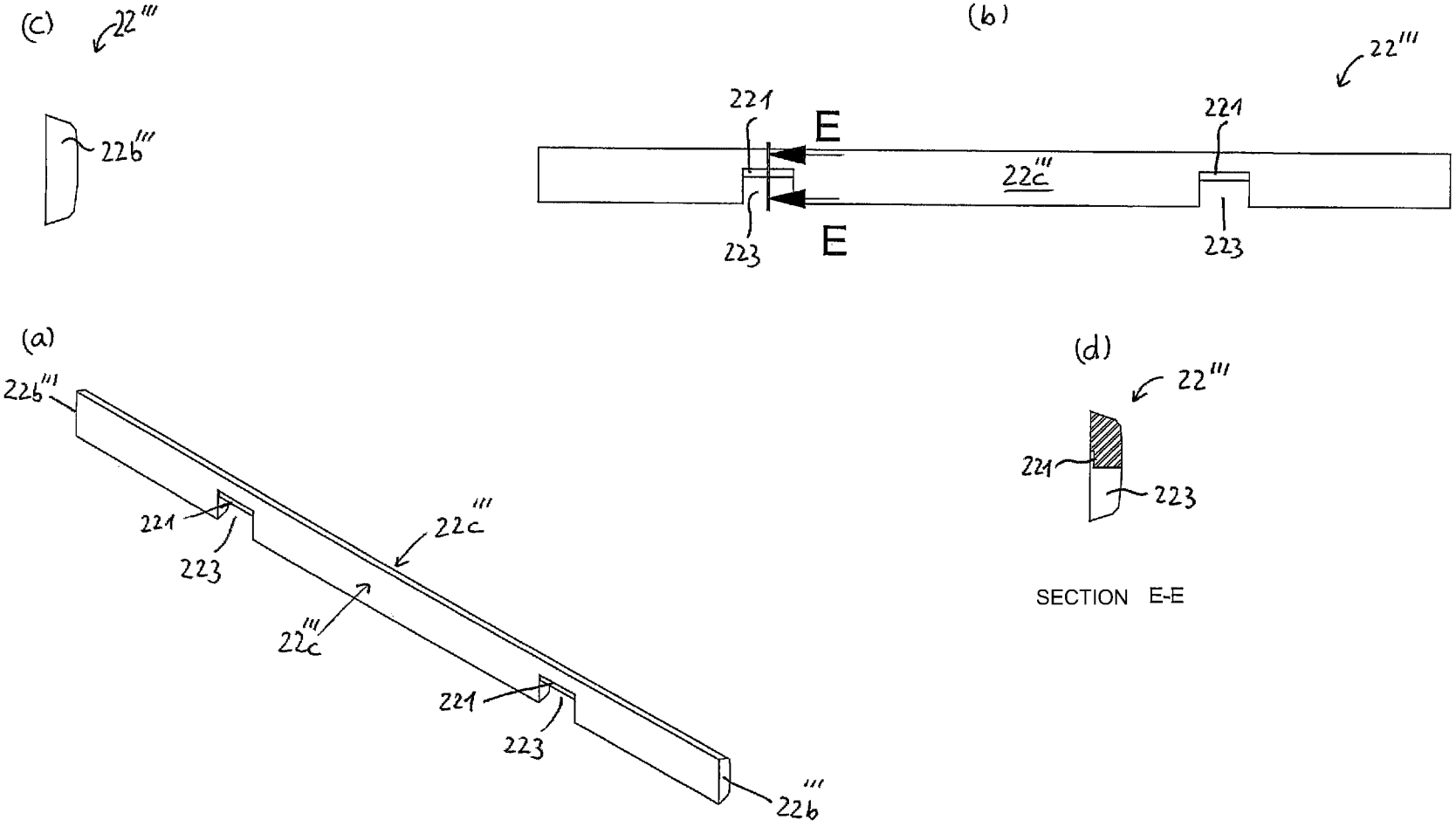
FIG. 18: various views of a filler block element in an embodiment adapted to a support block with spacing web.

Referring to FIGS. 16, 18 and 19, filler block elements 22' are used in this case, which have recesses 223 for the spacer webs 43 of the support blocks 40 and the fastening bolts 27. Alternatively, it is possible that the filler block elements comprise the slots matched to the spacing webs 43 and transverse channels for the fastening bolts.

Figure 20:
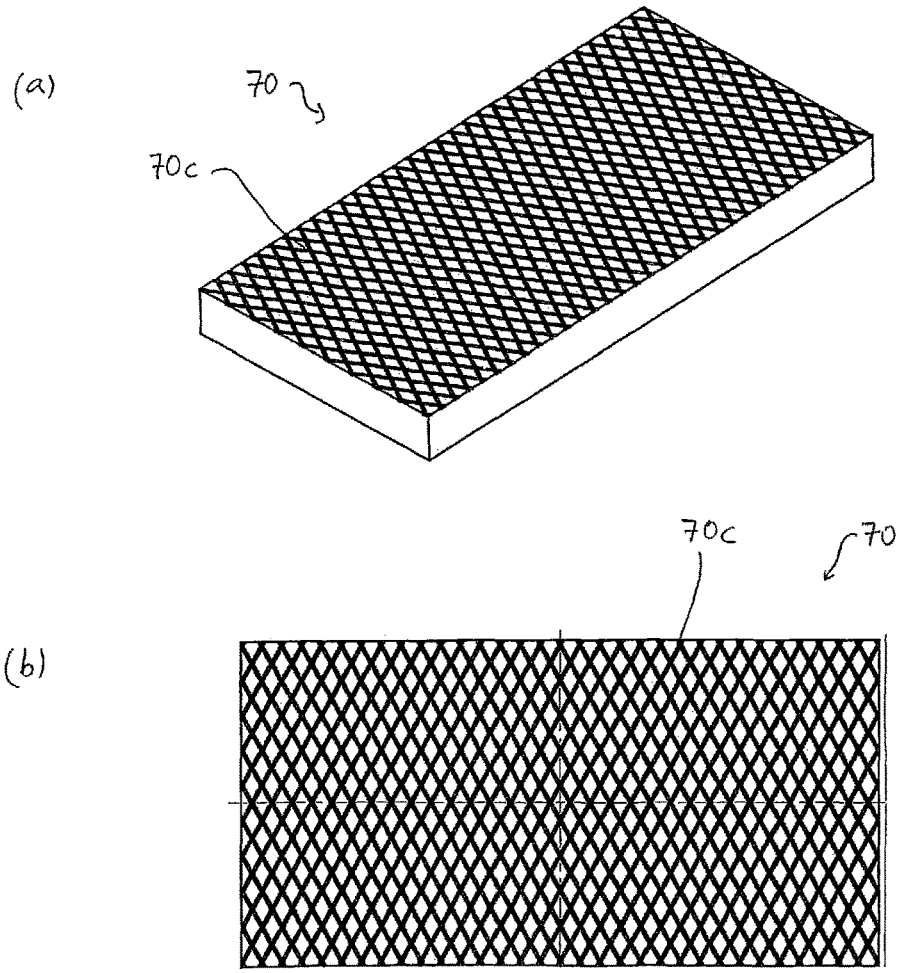
FIG. 20: two schematic representations of a moulding with anti-slip surface 20.

Referring to FIG. 20 it can be foreseen that the surfaces of the mouldings that form the traffic area across the railway crossing are configured in anti-slip form in order to ensure safe driving and entering the railway crossing, particularly when wet. Corresponding to the moulding 70, as schematically shown in FIG. 20 in respect of its outer shape, a grooved surface 70*c* can be provided. The hatching in the surface 70*c* indicates here a rhombus-like corrugation. Further, the slip resistance of the surface of the mouldings serving as traffic area can be increased by coating the surfaces with mineral mixtures, corundum sand, or equivalent.

Figure 21:
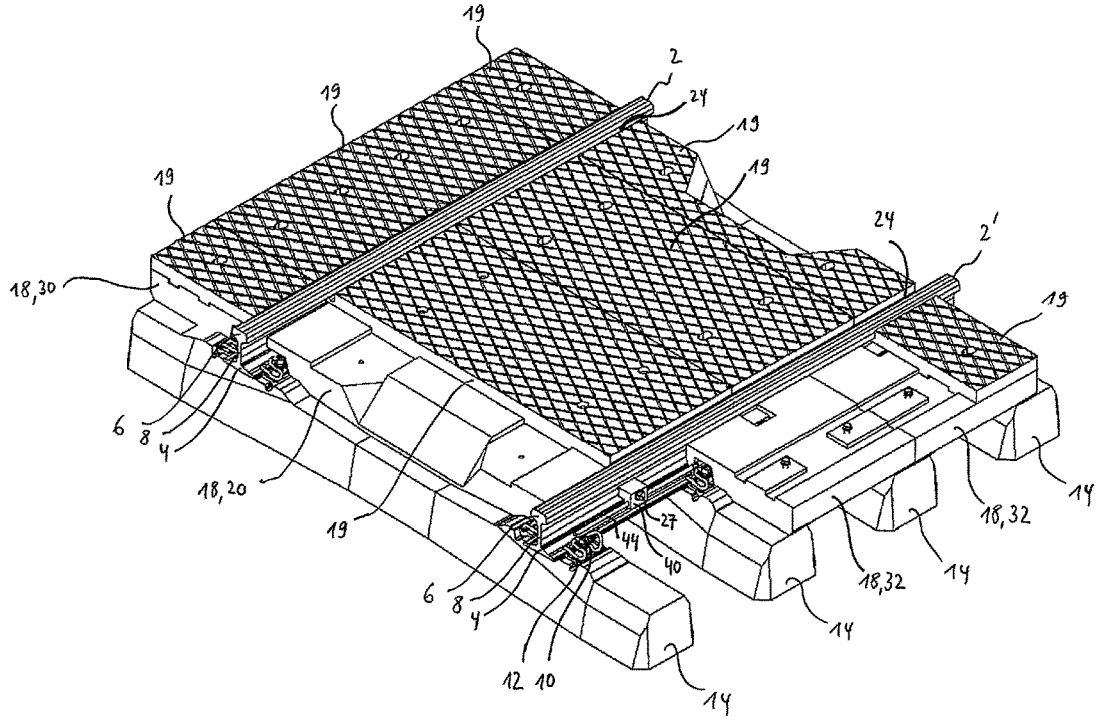
FIG. 21: perspective view of a track section with partially erected level crossing in an embodiment comprising base plate mouldings and cover plate mouldings.

Referring to FIG. 21, intermediate rail mouldings 20 and/or rail outer-side mouldings 30, 32 each can be set up as base plate mouldings 18, in which cover plates mouldings 19 rest on the base plate mouldings 18. In this vertically two-part embodiment in particular, the lower base plate mouldings 18 can be fixed or locked as per the foregoing embodiment with fastening bolts 27, support blocks 40 and securing bars 44.

Figure 22:
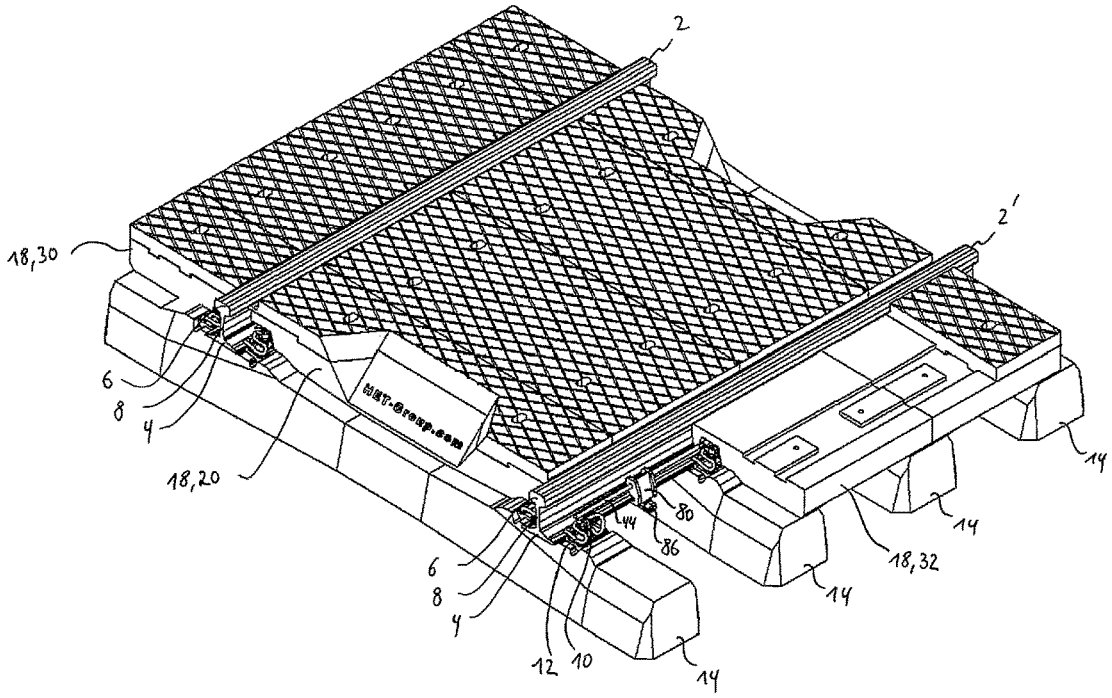
FIG. 22: perspective view of a track section with partially erected level crossing in the embodiment of FIG. 21, wherein said moulding is fixed to the rails by means of moulded part holders.
Figure 23:
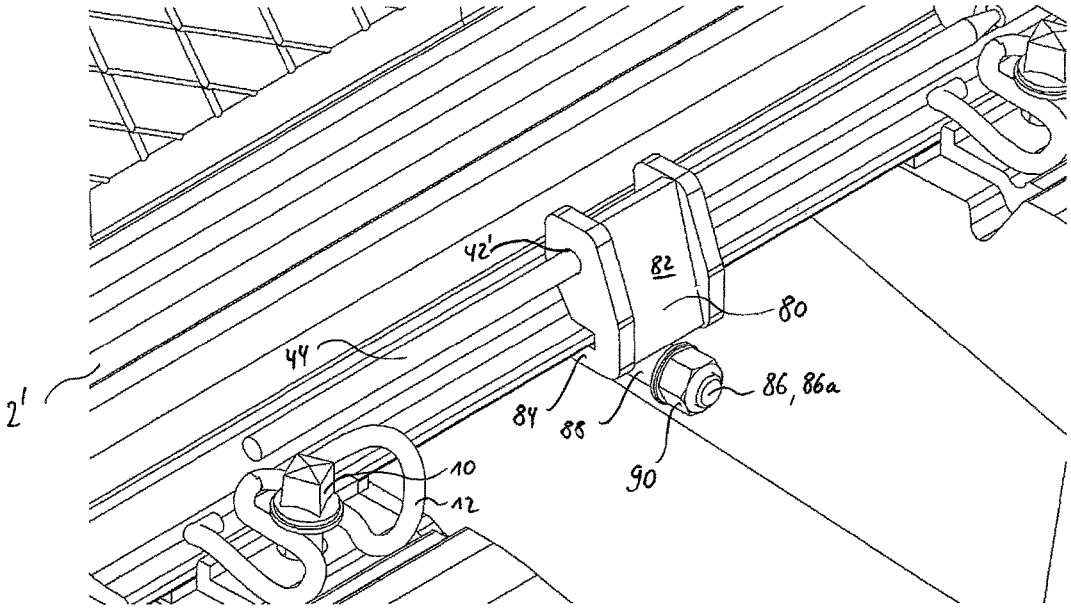
FIG. 23: a detail view of a moulding holder of FIG. 22, FIG. 24: a sectional view of FIG. 22 in the region of a moulding holder.

FIGS. 22 and 23 show the example of the vertical two-part design, but are not limited to this configuration, another type of fixing. The base plate mouldings 18, or the intermediate rail mouldings 20, 20' and/or the rail outer-side mouldings 30, 32, 30', 32', in the case of the embodiment according to FIG. 1 or 9, hereinafter generally referred to as mouldings, are fixed in this case by means of a moulding holder 80 on the respective rails 2, 2'. A moulding holder 80 is directly secured to a rail. A cross bore through the rail web 8 is therefore not required in this case.

The mouldings, which are adjacent to each one of the outer sides of the two rails 2, 2', are each fixed to a rail by means of a moulding holder 80, while the moulding which is located between the two rails 2, 2', and is fixed on both rails 2, 2' by means of a respective moulding holder 80. An operation of the mouldings in the rail chamber is therefore not required. The fixing of a moulding to the rail 2, 2' by means of a moulding holder 80 or by means of a cross bore 26 (as described above) is safer and more stable than a fixing by the operation of the moulding in the rail chamber and also facilitates the assembly because the moulding does not need to be arranged in the rail chamber.

In order to build a railroad crossing having a sufficient width, several mouldings are usually arranged side by side along the track section, whereby often, as already described above, three groups of mouldings are laid. A plurality of moulding holders 80 can be fixed in a regular interval along the respective rail 2, 2', in order to fix the groups of mouldings thereon. In this case, the moulding holders 80 are located at an appropriate rail 2 at the same positions along the track direction like the moulding holders 80 at the other rail 2'.

In the Figures as shown, at least one moulding holder 80 is provided for a moulding in each case. However, a plurality of mouldings (for example, mouldings of a group) adjacently disposed in the track direction can be fixed together at a moulding holder 80. This helps to reduce the number of moulding holders 80.

The preferably metallic moulding holders 80 can be retrofitted to an existing track grid with sleepers 14 and attached to secured rails 2, 2' so as to set up a railroad crossing over the track grid. As illustrated, the moulding holders 80 are preferably secured between the sleepers 14 and/or between the rail-foot fixing devices 10, 12 at the rails 2, 2'. Thus, the mouldings can be fixed by means of the moulding holders 80 directly onto the rails 2, 2'. This allows a particularly secure and stable fixing of the bodies at the track grid, particularly in the area close to the track. The locking of a moulding at a moulding holder 80 can be accordingly carried out as described above in connection with a support block 40. The above designs similarly apply to the moulding holder 80.

A moulding can accordingly be locked to the associated moulding holder 80 having a safety bar 44, and thus secured against a lift out upwards and against lateral removal away from the rail. In the locked state, the safety bar 44 extends longitudinally along the track section through a longitudinal bore 42' in the moulding holder 80. The safety bar 44 also extends longitudinally along the track section through a longitudinal channel in the mouldings so that the moulding at the moulding holder 80 is fixed.

Figure 24:
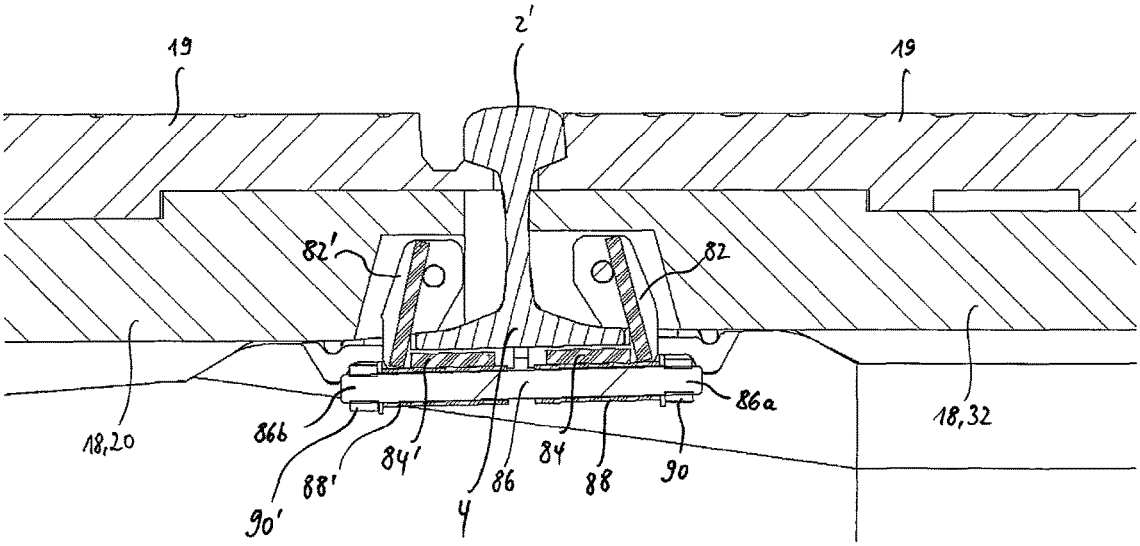
Figure 25:
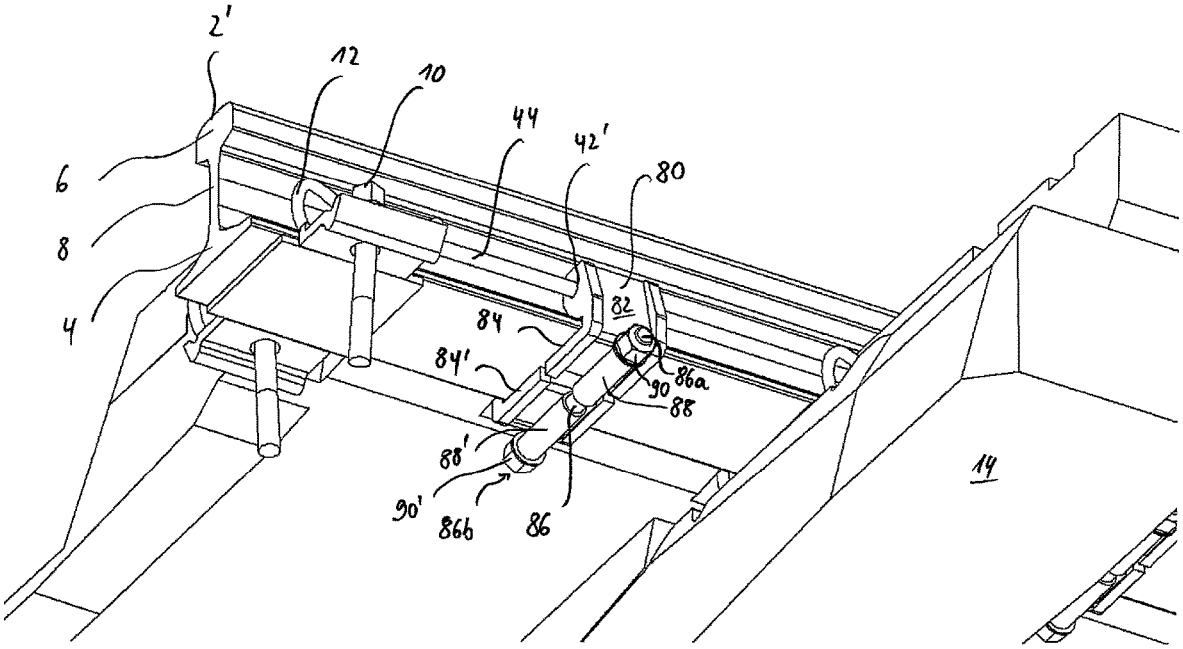
FIG. 25: a perspective view from below the moulding holder fixed at the rail, FIG. 26(*a*): a lateral view, and (b): a perspective view of a moulded part holder.
Figure 26:
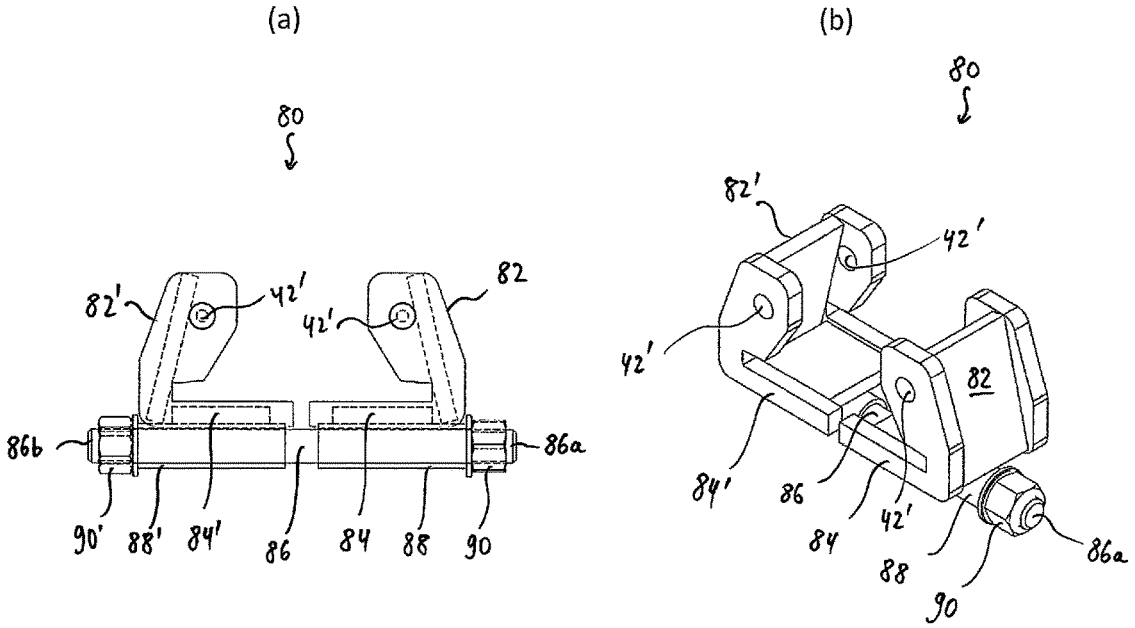

Referring to FIGS. 24, 25 and 26, the mouldings holder 80 is designed as a clamp, which can be clamped to the rail. In this example, a moulding holder 80 has two holding clamps 82, 82', which are symmetrically set up in the example shown. The two holding clamps 82, 82' set up as holding clips embrace respectively the rail foot 4 and are arranged on both sides of the rail 2' in juxtaposition to each other.

The holding clamps 82, 82' each have a rail-foot base grip section 84, 84', which rests on the underside of the rail foot. 4 The holding clamps 82, 82' of a moulding holder 80 are clamped together by means of a clamping bolt 86. For this purpose, the holding clamps 82, 82' each have a tensioning bolt guide 88, 88', wherein the clamping bolt 86 extends together through the clamping bolt guides 88, 88' of both holding clamps 82, 82'. The clamping bolt guides 88, 88' and the clamping bolt 86 pass beneath the rail foot 4. In the example shown, the clamping bolt guides 88, 88' are arranged respectively on the rail-foot base grip section 84, 84'. The clamping bolt 86 has two threaded ends **86*a* and 86*b*, on each of which a clamping nut 90, 90' is bolted, in order to brace the holding clamps 82, 82' with each other and against the rail foot 4. In the braced state, the rail foot 4 is therefore clamped between the two holding clamps 82, 82' of a moulding holder 80**, similar to a clamp.

In a further embodiment not shown, the opposed holding clamps 82, 82' of a moulding holder 80 can be clamped with each other on the rail through a cross bore 26. According to the same principle, two support blocks 40 can be bolted to a rail through a cross bore 26 in juxtaposition to each other.

Figure 27:
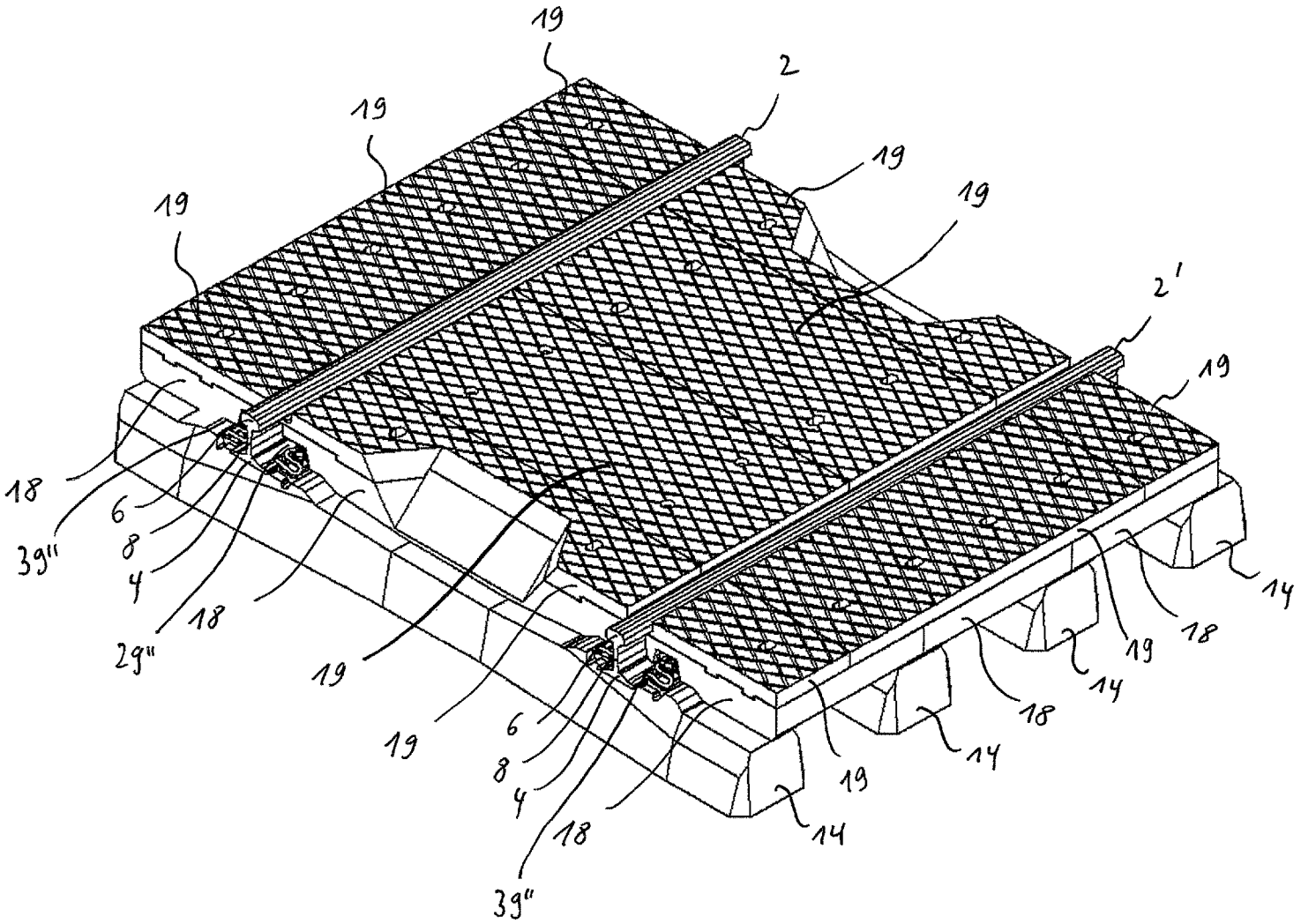
FIG. 27: a perspective view of a track section with a railroad crossing in the embodiment of FIG. 21, FIG. 28: a sectional view of FIG. 27 in the region of a moulding holder.

For all embodiments, it is preferably provided such that a moulding, for example, an intermediate rail moulding 20, 20', a track outer-side mouldings 30, 32, 30', 32', a base plate moulding 18, or a cover plate moulding 19, has a certain minimum thickness in the vertical direction with regard to the built-in state. This ensures a sufficient stability of the level crossing and/or of the individual mouldings, particularly in mouldings made of rubber-elastic material, in particular bonded rubber granulate or vulcanized rubber. Accordingly, at least in the major part of its horizontal extent, a moulding has a thickness, which corresponds to at least half, preferably at least to the entire height of the rail head, for example, at least 25 mm or at least 50 mm. Specifically, one or more mouldings 20, 20', 30, 32, 30', 32', 18, 19 consist of not only a thin rigid metal plate with securing blocks, flange-mounted on the sides. FIG. 27 shows a crossing with lower base plate mouldings 18 and overlying cover plate mouldings 19. While the base plate mouldings 18 rest at least partially on the sleepers 14 and the rail feet 4 and form a supporting part of the traffic area of the level crossing, the upper cover plate mouldings 19 reach the height of the running surfaces of the rails 2, 2' and form the surface of the traffic area of the level crossing. With the vertical two-part design the upper cover plates can be replaced relatively easily, especially when only the surface of the traffic area is to be renewed, and that the cover plates and the base plates can be fabricated each with substantially lower and thus practically more manageable weights. This makes it possible in particular, that the mouldings of construction can be laid without the use of a construction machine.

Both the top plate mouldings 19 and the base plate mouldings 18 consist of an elastomer or an elastomer blend, and preferably each have a mass of less than 100 kg, preferably less than 90 kg, more preferably less than 85 kg.

The base plate mouldings 18 have, in the direction of the track, an extension that corresponds to the threshold distance, so that they can lie along the track direction on two adjacent sleepers 14 side by side. The base plates mouldings 18 are thus arranged in the direction of the track arranged according to a base plate grid, which is determined by the threshold distance. The cover plates moulding 19, in contrast, can be arranged in accordance with a deviating or offset cover plate grid in the track direction. In the example shown, the cover plate mouldings 19 each are laid offset relative to the base plate mouldings, wherein for the mouldings lying between the rails, the top plate grid is offset against the base plate grid by half a sleeper spacing. Generally, the grid spacing can differ, in this example, the cover plates mouldings 19, lying outside, in the direction of the track have a different dimension than the base plate moulding 18. During a displacement of the cover plates against the base plates, for example, an offset of the frontal impact, the stability of the level crossing increases, the flexible cover plate grid can serve to dimension the weights of the moulding, as desired.

The base plate mouldings 18 are each fixed directly detachably but firmly to the rails 2, 2', whereby generally it can be foreseen that the base plate mouldings 18 are detachably but firmly fixed in each case with the track system, in particular bolted. The cover plate mouldings 19 in contrast, are clamped under the rail heads 6. However, the cover plate mouldings 19 with the underlying base plate mouldings 18 are connected detachably but firmly, for example, fixed thereto, preferably by bolting.

Figure 28:
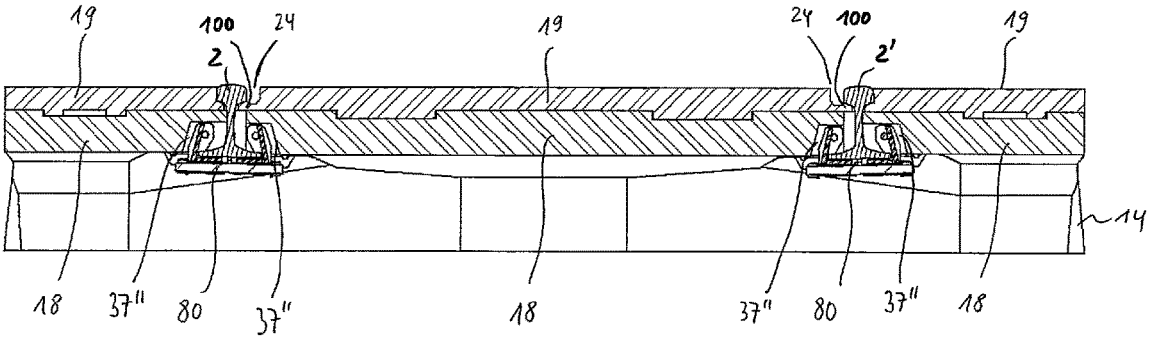
Figure 29:
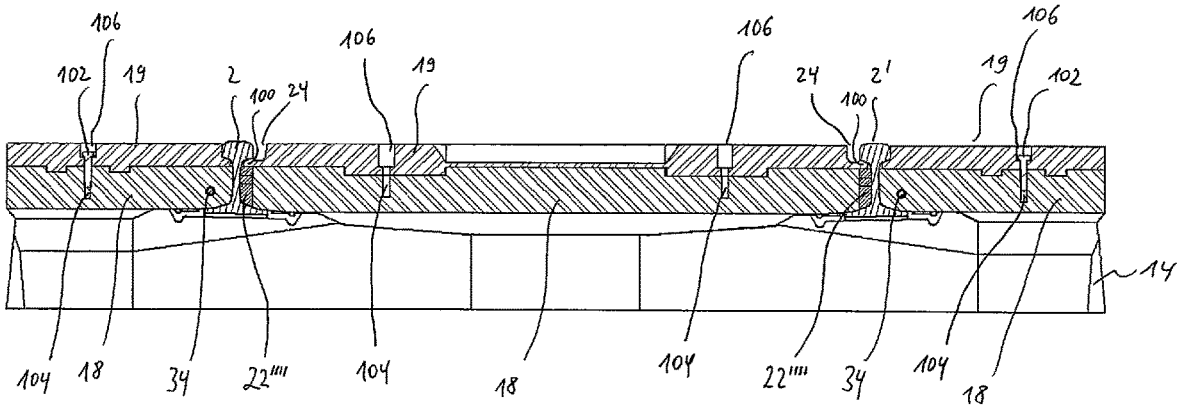
FIG. 29: a sectional view of FIG. 27 in the region of a bolt of cover plate mouldings having base plates mouldings.

Referring to FIGS. 28 and 29, the upper cover plate mouldings 19 have track grooves 24 and an edge bead 80, which intervenes under the rail head 6 in the rail chamber and fills at least partially. Apart from the track grooves 24 in the region close to the track, the cover plate mouldings 19 are flat, in particular set up without further grooves. However, the passable or accessible surface of the cover plate mouldings 19 can be designed rough or structured to reduce the danger of slipping.

The base plate mouldings 18 laid between the rails 2, 2' and the cover plate mouldings 19 extend transverse to the track section from the first rail 2 to the second rail 2' and the base plate and cover plate mouldings 18, 19 adjoining one of the outer sides of one of the two rails extend from the respective rail to the subsequent, not shown here, traffic area.

The lower base plate moulding 18 rest in each case on the rail foot 4 of the respective rails 2, 2', and are based on it, whereby said recesses 29", 39" are foreseen for the rail-foot securing devices 10, 12 (see FIG. 27) as well as recesses 37" for the moulding holder 80 or (for fixing by means of cross bores 26) for the support means 40 and/or fastening means 27. In this example, the recesses are not set up continuously but discretely along the track direction and can each be configured custom-fit so that the mouldings are hereby locked longitudinally along the track direction.

Arranged between the rails the base plate mouldings 18 preferably do not intervene in the rail chamber and does not fill-out the rail chamber, so that the base plate moulding 18, arranged between the rails, can be lowered during installation vertically from above up to the rail foot 4, without having to be located in the rail chamber. Rather, the rail chambers are filled-out on the inner side of the rails 2, 2 with filler block elements 22" ". By contrast, the base plate mouldings 18 bordering on the outer sides of the rails intervene in the rail chambers and fill them out, because these mouldings can laterally be inserted into the rail chamber before the connection is made to the adjacent traffic area. Thus, one can dispense with filler block elements on the outer sides of the rails. This can be provided similar to the vertical one-piece design of the intermediate rail mouldings 20 and/or track outer-side mouldings 30, 32.

Using bolts 102, the top plate mouldings 19 can be bolted to the base plate mouldings 18, wherein the bolts 102 are shown here only for the outside mouldings. Four bolts each can, for example, be provided for the cover plates between the rails and two bolts for the outside cover plates.

Figure 30:
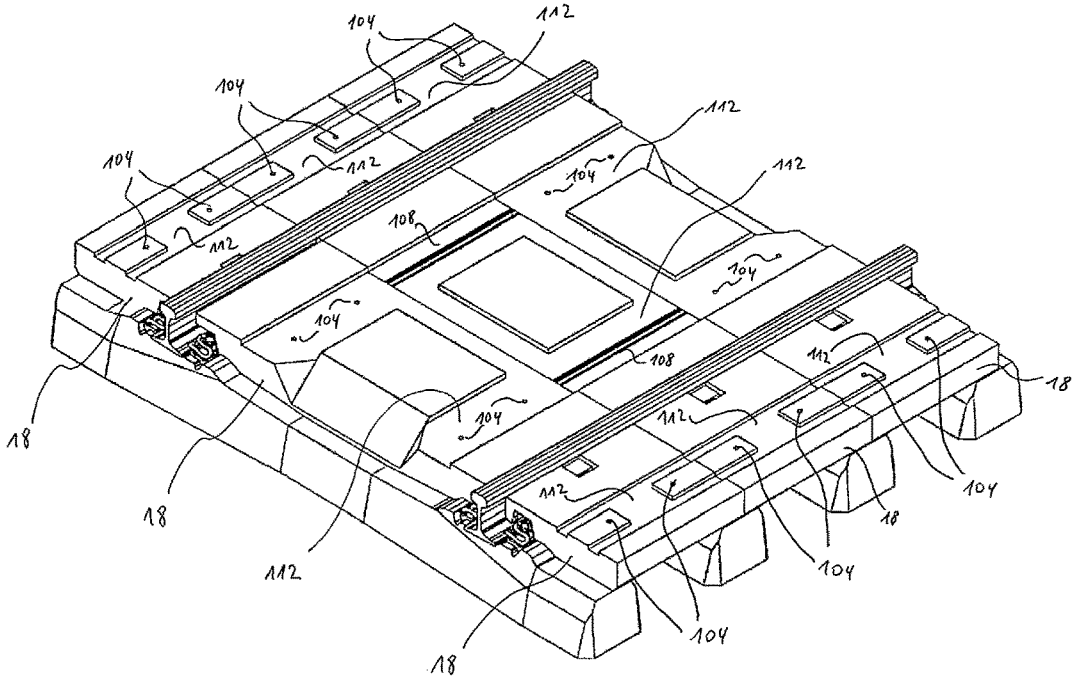
FIG. 30: a perspective view of the track section from FIG. 27, in which only base plates mouldings are installed.
Figure 31:
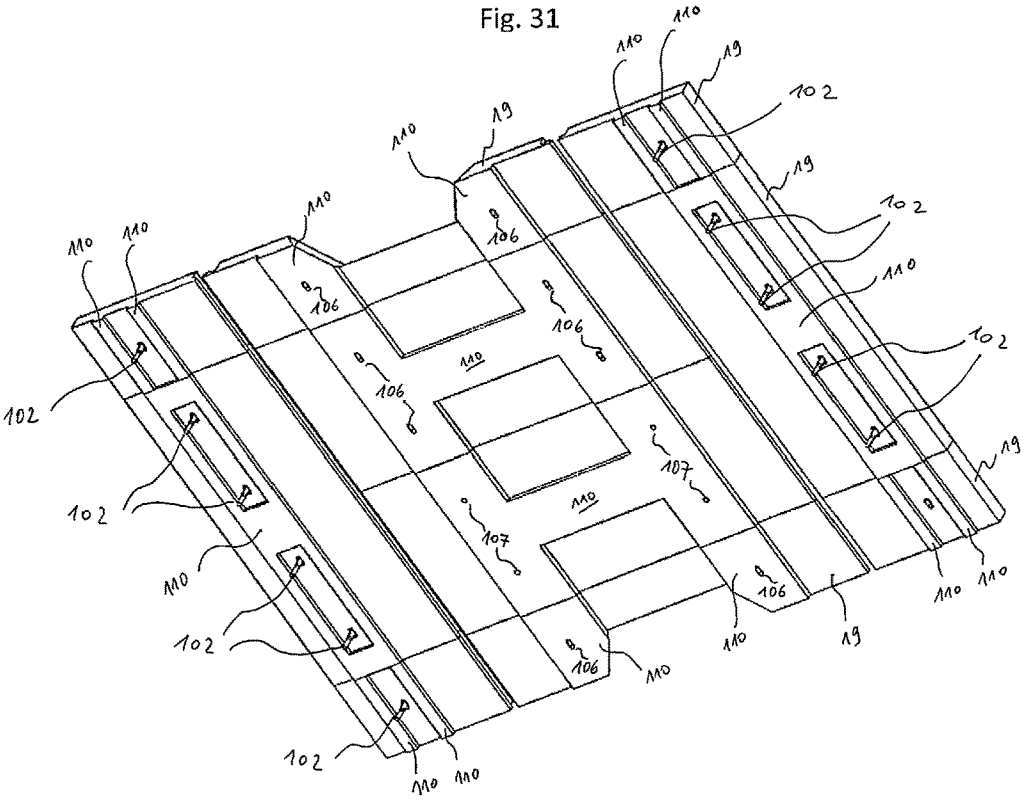
FIG. 31: a perspective bottom view of an arrangement of cover plate mouldings adapted to the built-in base plate mouldings of FIG. 30.

Referring to FIGS. 30 and 31, two ways are illustrated, in order to ensure a tolerance in the track direction for the screw fitting. On the one hand, oblong holes 106 can be introduced in the cover plates. Bolts 102 can then be screwed through the oblong holes 106, for example, into threaded inserts 104 in the base plates. On the other hand, C-rail inserts 108 can be incorporated in the base plates longitudinally along the track direction. Bolts 102 can then be fixed, for example, through round bores 107 in the cover plates in the C-rail inserts 108. The bolting of cover plates to the base plates ensures, in particular, a vertical fixing of the cover plates.

In order to further improve the horizontal fixing of the cover plate mouldings 19 with respect to the base plate mouldings, a positive engagement of a moulding projection 110 into a moulding recess 112 is considered expedient. In the illustrated example, the cover plate mouldings 19 have positive projections 110, which as negative recesses 112 are to be found in the base plates mouldings 18. The moulding projections 110 and the moulding recesses 112 are preferably set up so that a securing of the cover plates is carried out both longitudinally and transversely to the rail route. To the person skilled in the art it becomes apparent that the above-described embodiments are to be understood exemplary and the present disclosure is not limited to these, but can be varied in many ways without departing from the scope of the claims. Further, it is evident that the characteristics regardless of whether they have been disclosed in the description, claims, figures or otherwise, define individual components of the present disclosure, even if they are described together with other features.

I claim:

1. A device for setting up a railway crossing to cross a railway track forming a driving surface for rail vehicles, the railway crossing forming a traffic surface for motorized and/or non-motorized road users, so that the road users can cross the railway track over the railway crossing, wherein the railway track comprises two rails, each having a rail foot, a rail head and a rail web interconnecting the rail head and the rail foot, comprising:

one or more mouldings forming at least one part of the traffic surface of the railway crossing across the rails, and at least one moulding holder fixable to one of the two rails of the railway track forming the driving surface for the rail vehicles, wherein the moulding(s) is/(are) detachably attachable, by means of the moulding holder, to at least one of the two rails of the railway track forming the driving surface for the rail vehicles, wherein the moulding holder comprises two holding clamps fixable to the rail in juxtaposition to each other on both sides of the rail, and wherein the two holding clamps can be braced to each other to clamp the rail foot between the two holding clamps.

2. A device according to claim 1, wherein the moulding(s) is/(are) locked to the moulding holder in a direction along a perpendicular direction, in order to secure the moulding(s) from lifting upward.

3. A device according to claim 1, wherein the moulding(s) is/(are) locked at the moulding holder in a direction transverse to the vertical direction and transverse to the track section, in order to secure the moulding(s) against a horizontal removal from the rail.

4. A device according to claim 1, wherein the moulding(s) has/(have) a longitudinal channel along the track section, wherein an oblong securing device extends through the longitudinal channel along the track section and is locked on the moulding holder in a direction along a perpendicular line and/or in a direction transverse to the perpendicular line and transverse to the track section, in particular, by engaging the oblong securing device on the moulding holder.

5. A device according to claim 1, wherein the moulding(s) can be fixed on the rail on both sides of the rail by means of respective ones of the holding clamps of the moulding holder.

6. A device according to claim 1, wherein the two holding clamps of the moulding holder clasp the rail foot of the rail by means of a clamping bolt running below the rail foot transversely to the rail.

7. A device according to claim 1, wherein the moulding(s) include a total of at least three mouldings and two moulding holders, wherein the two moulding holders are fastened on both rails and wherein one of the mouldings is arranged between the two rails and is fixed by means of the two moulding holders on both rails, and wherein two of the mouldings abut outer sides of the two rails and are fixed by means of the two moulding holders on the two rails.

8. A device according to claim 1, wherein first and second groups of mouldings abutting outer sides of the two rails and a third group of mouldings arranged between the rails are included, wherein the mouldings of the first, second, and third groups extend abutting one another along the rails, so that the first, third and second groups of mouldings form in a two-dimensional space, the traffic surface of the railway crossing across the rails.

9. A device for setting up a railway crossing to cross a railway track, particularly a traffic surface for motorized and/or non-motorized road users, so that the road users can cross a track section over the railway crossing, wherein the track section comprises two rails, each having a rail foot, a rail head and the rail web interconnecting the rail head and the rail foot, comprising:

one or more mouldings forming at least one part of the traffic surface of the railway crossing across the rails, either at least one moulding holder fixable to one of the two rails or at least one transverse bore through the rail web of at least one of the two rails, wherein the moulding(s) is/(are) detachably attachable to at least one of the two rails, either by means of the moulding holder or by means of the transverse bore, wherein first and second groups of mouldings abutting outer sides of the two rails and a third group of mouldings arranged between the rails are included, wherein the mouldings of the first, second, and third groups extend abutting one another along the rails, so that the first, third and second groups of mouldings form in a two-dimensional space, the traffic surface of the railway crossing across the rails, and wherein the mouldings of at least one of the groups show a same longitudinal channel, so that an oblong securing device extends through the longitudinal channel of all mouldings of this group and is locked at the moulding holder in a direction along a perpendicular direction, in order to secure this group of mouldings from lifting upward.

10. A device according to claim 1, wherein the moulding(s) is/(are) supported on the rail foot of the respective rail.

11. A device according to claim 1, wherein the moulding(s) has/(have) recesses at the bottom for rail foot fasteners and at least one recess for the moulding holder.

12. A device for setting up a railway crossing to cross a railway track, particularly a traffic surface for motorized and/or non-motorized road users, so that the road users can cross a track section over the railway crossing, wherein the track section comprises two rails, each having a rail foot, a rail head and the rail web interconnecting the rail head and the rail foot, comprising:

one or more mouldings forming at least one part of the traffic surface of the railway crossing across the rails, either at least one moulding holder fixable to one of the two rails or at least one transverse bore through the rail web of at least one of the two rails, wherein the moulding(s) is/(are) detachably attachable to at least one of the two rails, either by means of the moulding holder or by means of the transverse bore, wherein the moulding(s) has/(have) recesses at the bottom for rail foot fasteners and at least one recess for the moulding holder, and wherein the recesses for the rail foot fasteners and/or said at least one recess for the moulding holder are not continuous, but discretely formed along the track section, so that the moulding(s) extends/(extend) between the recesses in one piece up to the rail foot and are supported on the associated rail.

13. A device according to claim 11, wherein at least one recess is designed for the moulding holder fitting exactly to the shape of the moulding holder, in order to lock the respective moulding to the moulding holder along the track section, when the respective moulding is fixed to the rail.

14. A device according to claim 1, wherein the moulding(s) does/(do) not engage a rail chamber formed between said rail head and the rail foot and does not fill the rail chamber, so that the moulding(s) can be lowered during installation vertically from top down to the rail foot without having to be threaded into the rail chamber.

15. A device according to claim 1, wherein at least one filler block element is included, which fills a rail chamber formed between the rail head and the rail foot and wherein the mouldings with their narrow sides facing the rails are supported at the at least one filler block element.

16. A device according to claim 1, wherein the moulding(s) are manufactured from rubber-elastic material, in particular bonded rubber granules or vulcanized rubber, wood, concrete, asphalt, or combination of them.

17. A method of constructing a railway crossing by incorporating a device, in particular according to claim 1, comprising:

a. providing the one or more mouldings and the at least one moulding holder, b. mounting the moulding holder on one of the two rails, c. placing the moulding between the two rails or abutting one of outer sides of the two rails, in order to form at least a portion of the traffic surface of the railway crossing across the rails, d. detachably fixing the moulding on the rail by means of the moulding holder.

18. A method according to claim 17, comprising:

a. providing at least three mouldings and at least two moulding holders, b. fastening the two moulding holders respectively on the two rails, c. placing one of the mouldings between the two rails and releasably fixing this moulding by means of the two moulding holders on two rails, and d. placing two of the mouldings each abutting one of outer sides of the two rails and detachably fixing the two mouldings in each case by means of one of the two moulding holders on one of the two rails.

19. A rail track crossing apparatus, comprising:

a moulding holder including holding clamps having rail-foot base grip sections configured to rest on an underside of a rail foot of a rail, and clamping bolt guides, and a clamping bolt configured to transversely extend through the clamping bolt guides of the holding clamps beneath the rail foot;

a securing bar configured to longitudinally extend through upper portions of the holding clamps; and a moulding including a longitudinal channel and configured to receive the securing bar therein.

* * * * *